US008297350B2

(12) United States Patent
Zupanick

(10) Patent No.: US 8,297,350 B2
(45) **Date of Patent: *Oct. 30, 2012**

(54) METHOD AND SYSTEM FOR ACCESSING SUBTERRANEAN DEPOSITS FROM THE SURFACE

(75) Inventor: Joseph A. Zupanick, Pineville, WV (US)

(73) Assignee: Vitruvian Exploration, LLC, The Woodlands, TX (US)

( * ) Notice: Subject to any disclaimer, the term of this patent is extended or adjusted under 35 U.S.C. 154(b) by 97 days.

This patent is subject to a terminal disclaimer.

(21) Appl. No.: 11/982,232

(22) Filed: Oct. 31, 2007

(65) Prior Publication Data

US 2008/0060800 A1 Mar. 13, 2008

Related U.S. Application Data

(60) Continuation of application No. 11/312,041, filed on Dec. 20, 2005, now abandoned, which is a continuation of application No. 10/641,856, filed on (Continued)

(51) Int. Cl.
*E21B 43/00* (2006.01)

(52) U.S. Cl. ..... 166/245; 166/50

(58) Field of Classification Search ..... 166/245, 166/50, 313, 52

See application file for complete search history.

(56) References Cited

U.S. PATENT DOCUMENTS 54,144 A 4/1866 Hamar (Continued)

FOREIGN PATENT DOCUMENTS

AU 85/49964 A 11/1986

(Continued)

OTHER PUBLICATIONS

*CNX Gas Corporation*, et al. v. *CDX Gas, LLC*, United States District Court, Western District of Pennsylvania (Pittsburgh), Civil Action No. 2:05-CV-1574-AJS, Civil Docket as of Oct. 24, 2007, 54 pages.

(Continued)

*Primary Examiner* — John Kreck

(74) *Attorney, Agent, or Firm* — Fish & Richardson P.C.

(57) ABSTRACT

Improved method and system for accessing subterranean deposits from the surface that substantially eliminates or reduces the disadvantages and problems associated with previous systems and methods. In particular, the present invention provides an articulated well with a drainage pattern that intersects a horizontal cavity well. The drainage patterns provide access to a large subterranean area from the surface while the vertical cavity well allows entrained water, hydrocarbons, and other deposits to be efficiently removed and/or produced.

18 Claims, 7 Drawing Sheets

Related U.S. Application Data

Aug. 15, 2003, now Pat. No. 6,976,533, which is a continuation of application No. 10/256,412, filed on Sep. 26, 2002, now Pat. No. 6,679,322, which is a continuation of application No. 09/885,219, filed on Jun. 20, 2001, now Pat. No. 6,561,288, which is a continuation of application No. 09/444,029, filed on Nov. 19, 1999, now Pat. No. 6,357,523, which is a continuation-in-part of application No. 09/197,687, filed on Nov. 20, 1998, now Pat. No. 6,280,000, said application No. 10/641,856 is a continuation-in-part of application No. 10/630,345, filed on Jul. 29, 2003, said application No. 10/256,412 is a continuation-in-part of application No. 10/165,627, filed on Jun. 7, 2002, now Pat. No. 6,668,918, which is a continuation of application No. 09/789,956, filed on Feb. 20, 2001, now Pat. No. 6,478,085, which is a division of application No. 09/444,029, which is a continuation-in-part of application No. 09/197,687, application No. 11/982,232, which is a continuation of application No. 10/630,345, which is a continuation-in-part of application No. 10/165,627, which is a continuation of application No. 09/789,956, which is a division of application No. 09/444,029, which is a continuation-in-part of application No. 09/197,687, said application No. 10/630,345 is a continuation-in-part of application No. 09/774,996, filed on Jan. 30, 2001, now Pat. No. 6,662,870, and a continuation-in-part of application No. 10/123,561, filed on Apr. 15, 2002, now Pat. No. 6,604,580, which is a division of application No. 09/773,217, filed on Jan. 30, 2001, now Pat. No. 6,425,448, and a continuation-in-part of application No. 09/885,219, which is a continuation of application No. 09/444,029, which is a continuation-in-part of application No. 09/197,687, said application No. 10/630,345 is a continuation-in-part of application No. 10/046,001, filed on Oct. 19, 2001, now Pat. No. 6,681,855, and a continuation-in-part of application No. 10/194,366, filed on Jul. 12, 2002, now Pat. No. 6,708,764, and a continuation-in-part of application No. 10/160,425, filed on May 31, 2002, now Pat. No. 6,962,216, and a continuation-in-part of application No. 10/079,794, filed on Feb. 19, 2002, now Pat. No. 6,988,566, and a continuation-in-part of application No. 10/004,316, filed on Oct. 30, 2001, now Pat. No. 7,048,049, and a continuation-in-part of application No. 10/227,057, filed on Aug. 22, 2002, now abandoned, which is a continuation-in-part of application No. 09/774,996, said application No. 10/630,345 is a continuation-in-part of application No. 10/323,192, filed on Dec. 18, 2002, now Pat. No. 7,025,154, which is a continuation-in-part of application No. 09/788,897, filed on Feb. 20, 2001, now Pat. No. 6,732,792, which is a division of application No. 09/444,029, which is a continuation-in-part of application No. 09/197,687, said application No. 10/630,345 is a continuation-in-part of application No. 10/264,535, filed on Oct. 3, 2002, now Pat. No. 6,988,548, and a continuation-in-part of application No. 10/244,082, filed on Sep. 12, 2002, now Pat. No. 7,073,595, and a continuation-in-part of application No. 09/769,098, filed on Jan. 24, 2001, now Pat. No. 6,598,686, which is a continuation-in-part of application No. 09/696,338, filed on Oct. 24, 2000, now Pat. No. 6,454,000, which is a continuation-in-part of application No. 09/444,029, which is a continuation-in-part of application No. 09/197,687, said application No. 10/630,345 is a continuation-in-part of application No. 10/003,917, filed on Nov. 1, 2001, which is a continuation-in-part of application No. 09/444,029, which is a continuation-in-part of application No. 09/197,687.

U.S. PATENT DOCUMENTS

| | | | |
|---|---|---|---|
| 274,740 | A | 3/1883 | Douglass |
| 526,708 | A | 10/1894 | Horton |
| 639,036 | A | 12/1899 | Heald |
| 1,189,560 | A | 7/1916 | Gondos |
| 1,285,347 | A | 11/1918 | Otto |
| 1,467,480 | A | 9/1923 | Hogue |
| 1,485,615 | A | 3/1924 | Jones |
| 1,488,106 | A | 3/1924 | Fitzpatrick |
| 1,520,737 | A | 12/1924 | Wright |
| 1,674,392 | A | 6/1928 | Flansburg |
| 1,777,961 | A | 10/1930 | Capeliuschnicoff |
| 2,018,285 | A | 10/1935 | Schweitzer et al. |
| 2,069,482 | A | 2/1937 | Seay |
| 2,150,228 | A | 3/1939 | Lamb |
| 2,169,718 | A | 8/1939 | Böll et al. |
| 2,335,085 | A | 11/1943 | Roberts |
| 2,450,223 | A | 9/1948 | Barbour |
| 2,452,654 | A | 11/1948 | Hayes et al. |
| 2,490,350 | A | 12/1949 | Grable |
| 2,679,903 | A | 6/1954 | McGowen, Jr. et al. |
| 2,726,063 | A | 12/1955 | Ragland et al. |
| 2,726,847 | A | 12/1955 | McCune et al. |
| 2,783,018 | A | 2/1957 | Lytle |
| 2,797,893 | A | 7/1957 | McCune et al. |
| 2,847,189 | A | 8/1958 | Shook |
| 2,911,008 | A | 11/1959 | Du Bois |
| 2,934,904 | A | 5/1960 | Hendrix |
| 2,980,142 | A | 4/1961 | Turak |
| 3,135,293 | A | 6/1964 | Hulsey |
| 3,163,211 | A | 12/1964 | Henley |
| 3,208,537 | A | 9/1965 | Scarborough |
| 3,347,595 | A | 10/1967 | Dahms et al. |
| 3,362,475 | A | 1/1968 | Huitt et al. |
| 3,385,382 | A | 5/1968 | Canalizo et al. |
| 3,406,766 | A | 10/1968 | Henderson |
| 3,443,648 | A | 5/1969 | Howard |
| 3,473,571 | A | 10/1969 | Dugay |
| 3,503,377 | A | 3/1970 | Beatenbough et al. |
| 3,528,516 | A | 9/1970 | Brown |
| 3,530,675 | A | 9/1970 | Turzillo |
| 3,534,822 | A | 10/1970 | Campbell et al. |
| 3,578,077 | A | 5/1971 | Glenn, Jr. et al. |
| 3,582,138 | A | 6/1971 | Loofbourow et al. |
| 3,587,743 | A | 6/1971 | Howard |
| 3,647,230 | A | 3/1972 | Smedley |
| 3,684,041 | A | 8/1972 | Kammerer, Jr. et al. |
| 3,687,204 | A | 8/1972 | Marshall et al. |
| 3,692,041 | A | 9/1972 | Bondi |
| 3,744,565 | A | 7/1973 | Brown |
| 3,757,876 | A | 9/1973 | Pereau |
| 3,757,877 | A | 9/1973 | Leathers |
| 3,759,328 | A | 9/1973 | Ueber et al. |
| 3,763,652 | A | 10/1973 | Rinta |
| 3,800,830 | A | 4/1974 | Etter |
| 3,809,519 | A | 5/1974 | Garner |
| 3,825,081 | A | 7/1974 | McMahon |
| 3,828,867 | A | 8/1974 | Elwood |
| 3,874,413 | A | 4/1975 | Valdez |
| 3,887,008 | A | 6/1975 | Canfield |
| 3,902,322 | A | 9/1975 | Watanabe |
| 3,907,045 | A | 9/1975 | Dahl et al. |
| 3,934,649 | A | 1/1976 | Pasini, III et al. |
| 3,957,082 | A | 5/1976 | Fuson et al. |
| 3,961,824 | A | 6/1976 | Van Eek et al. |
| 4,011,890 | A | 3/1977 | Andersson |
| 4,020,901 | A | 5/1977 | Pisio et al. |
| 4,022,279 | A | 5/1977 | Driver |

4,030,310 A 6/1977 Schirtzinger
4,037,658 A 7/1977 Anderson
4,060,130 A 11/1977 Hart
4,073,351 A 2/1978 Baum
4,089,374 A 5/1978 Terry
4,106,575 A 8/1978 Bunnelle
4,116,012 A 9/1978 Abe et al.
4,134,463 A 1/1979 Allen
4,136,996 A 1/1979 Burns
4,137,975 A 2/1979 Pennock
4,151,880 A 5/1979 Vann
4,156,437 A 5/1979 Chivens et al.
4,169,510 A 10/1979 Meigs
4,182,423 A 1/1980 Ziebarth et al.
4,189,184 A 2/1980 Green
4,220,203 A 9/1980 Steeman
4,221,433 A 9/1980 Jacoby
4,222,611 A 9/1980 Larson et al.
4,224,989 A 9/1980 Blount
4,226,475 A 10/1980 Frosch et al.
4,257,650 A 3/1981 Allen
4,278,137 A 7/1981 Van Eek
4,283,088 A 8/1981 Tabakov et al.
4,296,785 A 10/1981 Vitello et al.
4,296,969 A 10/1981 Willman
4,299,295 A 11/1981 Gossard
4,303,127 A 12/1981 Freel et al.
4,305,464 A 12/1981 Masszi
4,312,377 A 1/1982 Knecht
4,317,492 A 3/1982 Summers et al.
4,328,577 A 5/1982 Abbott et al.
4,333,539 A 6/1982 Lyons et al.
4,356,866 A 11/1982 Savins
4,366,988 A 1/1983 Bodine
4,372,398 A 2/1983 Kuckes
4,386,665 A 6/1983 Dellinger
4,390,067 A 6/1983 Willman
4,396,075 A 8/1983 Wood et al.
4,396,076 A 8/1983 Inoue
4,397,360 A 8/1983 Schmidt
4,401,171 A 8/1983 Fuchs
4,407,376 A 10/1983 Inoue
4,415,205 A 11/1983 Rehm et al.
4,417,829 A 11/1983 Berezoutzky
4,422,505 A 12/1983 Collins
4,437,706 A 3/1984 Johnson
4,442,896 A 4/1984 Reale et al.
4,458,767 A 7/1984 Hoehn, Jr.
4,463,988 A 8/1984 Bouck et al.
4,494,616 A 1/1985 McKee
4,502,733 A 3/1985 Grubb
4,512,422 A 4/1985 Knisley
4,519,463 A 5/1985 Schuh
4,527,639 A 7/1985 Dickinson, III et al.
4,532,986 A 8/1985 Mims et al.
4,533,182 A 8/1985 Richards
4,536,035 A 8/1985 Huffman et al.
4,544,037 A 10/1985 Terry
4,558,744 A 12/1985 Gibb
4,565,252 A 1/1986 Campbell et al.
4,573,541 A 3/1986 Josse et al.
4,600,061 A 7/1986 Richards
4,603,592 A 8/1986 Siebold et al.
4,605,067 A 8/1986 Burton, Jr.
4,605,076 A 8/1986 Goodhart
4,611,855 A 9/1986 Richards
4,618,009 A 10/1986 Carter et al.
4,638,949 A 1/1987 Mancel
4,646,836 A 3/1987 Goodhart
4,651,836 A 3/1987 Richards
4,662,440 A 5/1987 Harmon et al.
4,674,579 A 6/1987 Geller et al.
4,676,313 A 6/1987 Rinaldi
4,702,314 A 10/1987 Huang et al.
4,705,109 A 11/1987 Ledent et al.
4,705,431 A 11/1987 Gadelle et al.
4,715,440 A 12/1987 Boxell et al.
4,718,485 A 1/1988 Brown et al.
RE32,623 E 3/1988 Marshall et al.
4,727,937 A 3/1988 Shum et al.
4,753,485 A 6/1988 Goodhart
4,754,808 A 7/1988 Harmon et al.
4,754,819 A 7/1988 Dellinger
4,756,367 A 7/1988 Puri et al.
4,763,734 A 8/1988 Dickinson et al.
4,773,488 A 9/1988 Bell et al.
4,776,638 A 10/1988 Hahn
4,830,105 A 5/1989 Petermann
4,832,122 A 5/1989 Corey et al.
4,836,611 A 6/1989 El-Saie
4,842,081 A 6/1989 Parant
4,844,182 A 7/1989 Tolle
4,852,666 A 8/1989 Brunet et al.
4,883,122 A 11/1989 Puri et al.
4,889,186 A 12/1989 Hanson et al.
4,978,172 A 12/1990 Schwoebel et al.
5,016,709 A 5/1991 Combe et al.
5,016,710 A 5/1991 Renard et al.
5,033,550 A 7/1991 Johnson et al.
5,035,605 A 7/1991 Dinerman et al.
5,036,921 A 8/1991 Pittard et al.
5,040,601 A 8/1991 Karlsson et al.
5,074,360 A 12/1991 Guinn
5,074,365 A 12/1991 Kuckes
5,074,366 A 12/1991 Karlsson et al.
5,082,054 A 1/1992 Kiamanesh
5,111,893 A 5/1992 Kvello-Aune
5,115,872 A 5/1992 Brunet et al.
5,127,457 A 7/1992 Stewart et al.
5,135,058 A 8/1992 Millgard et al.
5,148,875 A 9/1992 Karlsson et al.
5,148,877 A 9/1992 MacGregor
5,165,491 A 11/1992 Wilson
5,168,942 A 12/1992 Wydrinski
5,174,374 A 12/1992 Hailey
5,193,620 A 3/1993 Braddick
5,194,859 A 3/1993 Warren
5,197,553 A 3/1993 Leturno
5,197,783 A 3/1993 Theimer et al.
5,199,496 A 4/1993 Redus et al.
5,201,817 A 4/1993 Hailey
5,207,271 A 5/1993 Sanchez et al.
5,217,076 A 6/1993 Masek
5,226,495 A 7/1993 Jennings, Jr.
5,240,350 A 8/1993 Yamaguchi et al.
5,242,017 A 9/1993 Hailey
5,242,025 A 9/1993 Neill et al.
5,246,273 A 9/1993 Rosar
5,255,741 A 10/1993 Alexander
5,271,472 A 12/1993 Leturno
5,287,926 A 2/1994 Grupping
5,289,888 A 3/1994 Talley
5,301,760 A 4/1994 Graham
5,343,965 A 9/1994 Talley et al.
5,355,967 A 10/1994 Mueller et al.
5,363,927 A 11/1994 Frank
5,385,205 A 1/1995 Hailey
5,394,950 A 3/1995 Gardes
5,402,851 A 4/1995 Baiton
5,411,082 A 5/1995 Kennedy
5,411,085 A 5/1995 Moore et al.
5,411,088 A 5/1995 LeBlanc et al.
5,411,104 A 5/1995 Stanley
5,411,105 A 5/1995 Gray
5,431,220 A 7/1995 Lennon et al.
5,431,482 A 7/1995 Russo
5,435,400 A 7/1995 Smith
5,447,416 A 9/1995 Wittrisch
5,450,902 A 9/1995 Matthews
5,454,419 A 10/1995 Vloedman
5,458,209 A 10/1995 Hayes et al.
5,462,116 A 10/1995 Carroll
5,462,120 A 10/1995 Gondouin
5,469,155 A 11/1995 Archambeault et al.
5,477,923 A 12/1995 Jordan, Jr. et al.
5,485,089 A 1/1996 Kuckes
5,494,121 A 2/1996 Nackerud
5,499,687 A 3/1996 Lee 5,501,273 A 3/1996 Puri
5,501,279 A 3/1996 Garg et al.
5,520,252 A 5/1996 McNair
5,584,605 A 12/1996 Beard et al.
5,613,242 A 3/1997 Oddo
5,615,739 A 4/1997 Dallas
5,653,286 A 8/1997 McCoy et al.
5,664,911 A 9/1997 Bridges et al.
5,669,444 A 9/1997 Riese et al.
5,676,207 A 10/1997 Simon et al.
5,680,901 A 10/1997 Gardes
5,690,390 A 11/1997 Bithell
5,697,445 A 12/1997 Graham
5,706,871 A 1/1998 Andersson et al.
5,720,356 A 2/1998 Gardes
5,727,629 A 3/1998 Blizzard, Jr. et al.
5,733,067 A 3/1998 Hunt et al.
5,735,350 A 4/1998 Longbottom et al.
5,771,976 A 6/1998 Talley
5,775,433 A 7/1998 Hammett et al.
5,775,443 A 7/1998 Lott
5,785,133 A 7/1998 Murray et al.
5,832,958 A 11/1998 Cheng
5,853,054 A 12/1998 McGarian et al.
5,853,056 A 12/1998 Landers
5,853,224 A 12/1998 Riese
5,863,283 A 1/1999 Gardes
5,868,202 A 2/1999 Hsu
5,868,210 A 2/1999 Johnson et al.
5,879,057 A 3/1999 Schwoebel et al.
5,884,704 A 3/1999 Longbottom et al.
5,917,325 A 6/1999 Smith
5,934,390 A 8/1999 Uthe
5,938,004 A 8/1999 Roberts et al.
5,941,307 A 8/1999 Tubel
5,941,308 A 8/1999 Malone et al.
5,944,107 A 8/1999 Ohmer
5,957,539 A 9/1999 Durup et al.
5,971,074 A 10/1999 Longbottom et al.
5,988,278 A 11/1999 Johnson
5,992,524 A 11/1999 Graham
6,012,520 A 1/2000 Yu et al.
6,015,012 A 1/2000 Reddick
6,019,173 A 2/2000 Saurer et al.
6,024,171 A 2/2000 Montgomery et al.
6,030,048 A 2/2000 Hsu
6,050,335 A 4/2000 Parsons
6,056,059 A 5/2000 Ohmer
6,062,306 A 5/2000 Gano et al.
6,065,550 A 5/2000 Gardes
6,065,551 A 5/2000 Gourley et al.
6,079,495 A 6/2000 Ohmer
6,089,322 A 7/2000 Kelley et al.
6,119,771 A 9/2000 Gano et al.
6,119,776 A 9/2000 Graham et al.
6,135,208 A 10/2000 Gano et al.
6,170,571 B1 1/2001 Ohmer
6,179,054 B1 1/2001 Stewart
6,189,616 B1 2/2001 Gano et al.
6,192,988 B1 2/2001 Tubel
6,199,633 B1 3/2001 Longbottom
6,209,636 B1 4/2001 Roberts et al.
6,223,839 B1 5/2001 Fraim et al.
6,237,284 B1 5/2001 Erickson
6,244,340 B1 6/2001 McGlothen et al.
6,247,532 B1 6/2001 Ohmer
6,250,391 B1 6/2001 Proudfoot
6,263,965 B1 7/2001 Schmidt et al.
6,279,658 B1 8/2001 Donovan et al.
6,280,000 B1 8/2001 Zupanick
6,283,216 B1 9/2001 Ohmer
6,318,457 B1 11/2001 Den Boer et al.
6,349,769 B1 2/2002 Ohmer
6,357,523 B1 3/2002 Zupanick
6,357,530 B1 3/2002 Kennedy et al.
6,425,448 B1 7/2002 Zupanick et al.
6,439,320 B2 8/2002 Zupanick
6,450,256 B2 9/2002 Mones
6,454,000 B1 9/2002 Zupanick
6,457,525 B1 10/2002 Scott
6,457,540 B2 10/2002 Gardes
6,470,978 B2 10/2002 Trueman et al.
6,478,085 B2 11/2002 Zupanick
6,491,101 B2 12/2002 Ohmer
6,497,556 B2 12/2002 Zupanick et al.
6,554,063 B2 4/2003 Ohmer
6,557,628 B2 5/2003 Ohmer
6,561,277 B2 5/2003 Algeroy et al.
6,561,288 B2 5/2003 Zupanick
6,564,867 B2 5/2003 Ohmer
6,566,649 B1 5/2003 Mickael
6,571,888 B2 6/2003 Comeau et al.
6,575,235 B2 6/2003 Zupanick et al.
6,575,255 B1 6/2003 Rial et al.
6,577,129 B1 6/2003 Thompson et al.
6,581,455 B1 6/2003 Berger et al.
6,581,685 B2 6/2003 Burgess et al.
6,585,061 B2 7/2003 Radzinski et al.
6,590,202 B2 7/2003 Mickael
6,591,903 B2 7/2003 Ingle et al.
6,591,922 B1 7/2003 Rial et al.
6,595,301 B1 7/2003 Diamond et al.
6,595,302 B1 7/2003 Diamond et al.
6,598,686 B1 7/2003 Zupanick
6,604,580 B2 8/2003 Zupanick et al.
6,604,910 B1 8/2003 Zupanick
6,607,042 B2 8/2003 Hoyer et al.
6,636,159 B1 10/2003 Winnacker
6,639,210 B2 10/2003 Odom et al.
6,644,422 B1 11/2003 Rial et al.
6,646,441 B2 11/2003 Thompson et al.
6,653,839 B2 11/2003 Yuratich et al.
6,662,870 B1 12/2003 Zupanick et al.
6,668,918 B2 12/2003 Zupanick
6,679,322 B1 1/2004 Zupanick
6,681,855 B2 1/2004 Zupanick et al.
6,688,388 B2 2/2004 Zupanick
6,708,764 B2 3/2004 Zupanick
6,722,452 B1 4/2004 Rial et al.
6,725,922 B2 4/2004 Zupanick
6,732,792 B2 5/2004 Zupanick
6,745,855 B2 6/2004 Gardes
6,758,279 B2 7/2004 Moore et al.
6,758,289 B2 7/2004 Kelley et al.
6,766,859 B2 7/2004 Haugen et al.
RE38,642 E 11/2004 Gondouin
6,848,508 B2 2/2005 Zupanick
6,851,479 B1 2/2005 Zupanick et al.
6,860,147 B2 3/2005 Gunter et al.
6,866,106 B2 3/2005 Trueman et al.
6,923,275 B2 8/2005 Gardes
6,932,168 B2 8/2005 Morgan et al.
6,942,030 B2 9/2005 Zupanick
6,953,088 B2 10/2005 Rial et al.
6,962,030 B2 11/2005 Conn
6,964,298 B2 11/2005 Zupanick
6,964,308 B1 11/2005 Zupanick
6,968,893 B2 11/2005 Rusby et al.
6,976,533 B2 12/2005 Zupanick
6,976,547 B2 12/2005 Rial et al.
6,986,388 B2 1/2006 Zupanick et al.
6,988,548 B2 1/2006 Diamond et al.
6,991,047 B2 1/2006 Zupanick
6,991,048 B2 1/2006 Zupanick
7,025,137 B2 4/2006 Zupanick
7,025,154 B2 4/2006 Zupanick
7,036,584 B2 5/2006 Zupanick et al.
7,048,049 B2 5/2006 Zupanick
7,090,009 B2 8/2006 Zupanick
7,100,687 B2 9/2006 Pauley
7,207,395 B2 4/2007 Zupanick
7,222,670 B2 5/2007 Zupanick
7,387,165 B2 6/2008 Lopez de Cardenas et al.
7,543,648 B2 6/2009 Hill et al.
2002/0043404 A1 4/2002 Trueman et al.
2002/0096336 A1 7/2002 Zupanick et al.
2003/0234120 A1 12/2003 Paluch et al.
2004/0007353 A1 1/2004 Stave

| | | | |
|---|---|---|---|
| 2004/0033557 | A1 | 2/2004 | Scott et al. |
| 2004/0035582 | A1 | 2/2004 | Zupanick |
| 2004/0050554 | A1 | 3/2004 | Zupanick et al. |
| 2004/0108110 | A1 | 6/2004 | Zupanick |
| 2004/0140129 | A1 | 7/2004 | Gardes |
| 2004/0206493 | A1 | 10/2004 | Zupanick et al. |
| 2004/0244974 | A1 | 12/2004 | Zupanick et al. |
| 2005/0087340 | A1 | 4/2005 | Zupanick et al. |
| 2005/0109505 | A1 | 5/2005 | Seams |
| 2005/0115709 | A1 | 6/2005 | Zupanick et al. |
| 2005/0189117 | A1 | 9/2005 | Pringle et al. |
| 2005/0211473 | A1 | 9/2005 | Zupanick |
| 2005/0252689 | A1 | 11/2005 | Gardes |
| 2005/0257962 | A1 | 11/2005 | Zupanick |
| 2006/0000607 | A1 | 1/2006 | Surjaatmadja et al. |
| 2006/0096755 | A1 | 5/2006 | Zupanick |
| 2006/0266521 | A1 | 11/2006 | Pratt et al. |
| 2008/0060571 | A1 | 3/2008 | Zupanick |
| 2008/0060799 | A1 | 3/2008 | Zupanick |
| 2008/0060804 | A1 | 3/2008 | Zupanick |
| 2008/0060805 | A1 | 3/2008 | Zupanick |
| 2008/0060806 | A1 | 3/2008 | Zupanick |
| 2008/0060807 | A1 | 3/2008 | Zupanick |
| 2008/0066903 | A1 | 3/2008 | Zupanick |
| 2008/0149349 | A1 | 6/2008 | Hiron |
| 2008/0245525 | A1 | 10/2008 | Rivas et al. |

FOREIGN PATENT DOCUMENTS

| | | | |
|---|---|---|---|
| CA | 2210866 | | 1/1998 |
| CA | 2278735 | | 8/1998 |
| CH | 653741 | A5 | 1/1986 |
| CN | 248245 | Y | 2/1997 |
| CN | 1174587 | A | 2/1998 |
| CN | 1191586 | | 8/1998 |
| DE | 197 25 996 | A1 | 1/1998 |
| EP | 0 819 834 | A1 | 1/1998 |
| EP | 0 875 661 | A1 | 11/1998 |
| EP | 0 952 300 | A1 | 10/1999 |
| EP | 1 316 673 | A2 | 6/2003 |
| FR | 964503 | | 8/1950 |
| GB | 442008 | | 1/1936 |
| GB | 444484 | | 3/1936 |
| GB | 651468 | | 4/1951 |
| GB | 893869 | | 4/1962 |
| GB | 2 255 033 | A | 10/1992 |
| GB | 2 297 988 | A | 8/1996 |
| GB | 2 347 157 | A | 8/2000 |
| RU | 2097536 | C1 | 11/1997 |
| RU | 2136566 | C1 | 9/1999 |
| RU | 2176311 | C2 | 11/2001 |
| RU | 2179234 | C1 | 2/2002 |
| RU | 2205935 | C1 | 6/2003 |
| SU | 750108 | | 6/1975 |
| SU | 876968 | | 10/1981 |
| SU | 1448078 | A1 | 3/1987 |
| SU | 1448078 | A1 | 12/1988 |
| SU | 1770570 | A1 | 3/1990 |
| SU | 1709076 | A1 | 1/1992 |
| UA | 37720 | A | 5/2001 |
| WO | WO 94/21889 | | 9/1994 |
| WO | WO 94/28280 | | 12/1994 |
| WO | WO 97/21900 | | 6/1997 |
| WO | WO 98/25005 | | 6/1998 |
| WO | WO 98/35133 | | 8/1998 |
| WO | WO 99/60248 | | 11/1999 |
| WO | WO 00/31376 | | 6/2000 |
| WO | WO 00/79099 | A1 | 12/2000 |
| WO | WO 01/44620 | A1 | 6/2001 |
| WO | WO 02/18738 | A1 | 3/2002 |
| WO | WO 02/059455 | A1 | 8/2002 |
| WO | WO 02/061238 | A1 | 8/2002 |
| WO | WO 03/036023 | A1 | 5/2003 |
| WO | WO 03/038233 | | 5/2003 |
| WO | WO 03/102348 | A2 | 12/2003 |
| WO | WO 2004/035984 | A1 | 4/2004 |
| WO | WO 2005/003509 | A1 | 1/2005 |
| WO | WO 2005/012688 | | 2/2005 |

OTHER PUBLICATIONS

*CNX Gas Corporation*, et al. v. *CDX Gas, LLC*, United States District Court, Western District of Pennsylvania, Civil Action No. 05-CV-1574, Parties' Complaints and Answers, including Claims, Counterclaims and Affirmative Defenses, earliest dated Nov. 14, 2005, 506 pages.

*CNX Gas Corporation*, et al. v. *CDX Gas, LLC*, United States District Court, Western District of Pennsylvania, Civil Action No. 05-CV-1574, Parties' Filings on Claim Construction and Adopting Report and FRecommendation of special Master, including Briefs, Exhibits, Motions and Proposed Orders, earliest dated Mar. 16, 2006, 1,532 pages.

*CNX Gas Corporation*, et al. v. *CDX Gas, LLC*, United States District Court, Western District of Pennsylvania, Civil Action No. 05-CV-1574, Report and Recommendation and Order of Special Master, earliest dated Aug. 30, 2006, 28 pages, and Order of Court adopting report and recommendation of the Special Master as the opinion of the court, dated Oct. 13, 2006, 2 pages.

*CNX Gas Corporation*, et al. v. *CDX Gas, LLC*, United States District Court, Western District of Pennsylvania, Civil Action No. 05-CV-1574, Parties' Summary Judgment Filings on Entitlement of Asserted Claims of Patents-in-Suit to the Filing Date of '000 Patent, including Briefs, Exhibits, Motions, Proposed Orders and Statements of Undisputed Material Facts, earliest dated Jan. 5, 2007, 644 pages.

*CNX Gas Corporation*, et al. v. *CDX Gas, LLC*, United States District Court, Western District of Pennsylvania, Civil Action No. 05-CV-1574, Memorandum Opinion and Order of Court Re: Cross Motions for Partial Summary Judgment—Finding that the Asserted Claims of the Patent-in-Suit are Entitled to the filed of the '000 Patent and Order of Court, earliest dated Feb. 20, 2007, 4 pages.

*CNX Gas Corporation*, et al. v. *CDX Gas, LLC*, United States District Court, Western District of Pennsylvania, Civil Action No. 05-CV-1574, Parties' Discovery Responses, including Responses to Interrogatories and Responses to Requests for Admissions, earliest dated Jan. 18, 2006, 177 pages.

*CNX Gas Corporation*, et al. v. *CDX Gas, LLC*, United States District Court, Western District of Pennsylvania, Civil Action No. 05-CV-1574, Plaintiffs' Non-Infringement and Invalidity Contention Pursuant to LPR 3.4, including Attachment A with all Supplemental and updated Attachment A, dated Jan. 30, 2006, 934 pages.

Notification of Transmittal of the International Preliminary Report on Patentability (1 page) and International Preliminary Report on Patentability (10 pages) for International Application No. PCT/US2006/021057 mailed Jul. 9, 2007.

William P. Diamond and David C. Oyler, "Effects of Stimulation Treatments on Coalbeds and Surrounding Strata: Evidence From Underground Observations," RI 9083, Bureau of Mines Report of Investigations, 1987 (53 pages).

W.P. Diamond and D.C. Oyler, "Recent Underground Observations of Intercepted Hydraulic Stimulations in Coalbed Methane Drainage Wells," Preprint No. 85-332, Society of Mining Engineers of AIME, SME-AIME Fall Meeting, Oct. 16-18, 1985 (12 pages).

William P. Diamond, "Underground Observations of Mined-Through Stimulation Treatments of Coalbeds," Methane From Coal Seams Technology, Jun. 1987 (11 pages).

W.P. Diamond, "Characterization of Fracture Geometry and Roof Penetrations Associated with Stimulation Treatments in Coalbeds," 1987 Coalbed Methane Symposium, Nov. 16-19, 1987 (11 pages).

C.M. McCulloch, Maurice Deul and P.W. Jeran, "Cleat in Bituminous Coalbeds," RI 7910, Bureau of Mines Report of Investigations, 1974 (28 pages).

B.E. Law, "The Relationship Between Coal Rank and Cleat Spacing: Implications for the Prediction of Permeability in Coal," Proceedings of the 1993 International Coalbed Methane Symposium, May 17-21, 1993 (7 pages).

C.T. Montgomery and R.E. Steanson, "Proppant Selection: The Key to Successful Fracture Stimulation," Journal of Petroleum Technology, Dec. 1985 (10 pages).

R.W. Veatch, Jr., "Overview of Current Hydraulic Fracturing Design and Treatment Technology—Part 2," Journal of Petroleum Technology, May 1983 (12 pages).

David D. Cramer, "The Unique Aspects of Fracturing Western U.S. Coalbeds," Journal of Petroleum Technology, Oct. 1992 (8 pages).
S.A. Holditch, J.W. Ely, R.H. Carter, and M.E. Semmelbeck, Coal Seam Stimulation Manual, Gas Research Institute, Contract No. 5087-214-1469, Apr. 1990 (265 pages).
Jack E. Nolde, "Coalbed Methane in Virginia," Virginia Minerals, Virginia Division of Mineral Resources, vol. 41, Feb. 1995 (7 pages).
C.H. Elder and Maurice Deul, "Degasification of the Mary Lee Coalbed Near Oak Grove, Jefferson County, Ala., by Vertical Borehole in Advance of Mining," RI 7968, U.S. Bureau of Mines, 1974 (23 pages).
Maureen Lorenzetti, "Policymakers eye frac regulation to protect groundwater," Oil & Gas Journal, Sep. 10, 2001, p. 40 (1 page).
Peter F. Steidl, "Foam Stimulation To Enhance Production From Degasification Wells in the Pittsburgh Coalbed," RI 8286, Bureau of Mines Report of Investigations, 1978 (11 pages).
David G. Hill, "Contribution of Unconventional Gas to U.S. Supply Continues to Grow," Gas Research Institute Gas TIPS, Fall 2001 (6 pages).
Vello A. Kuuskraa and Charles F. Brandenburg, "Coalbed Methane Sparks a New Energy Industry," Oil & Gas Journal, Week of Oct. 9, 1989 (8 pages).
Walter B. Ayers Jr. and Bruce S. Kelso, "Knowledge of Methane Potential for Coalbed Resources Grows, But Needs More Study," Oil & Gas Journal, Oct. 23, 1989 (6 pages).
John E. McElhiney, Robert A. Koenig and Richard A. Schraufnagel, "Evaluation of Coalbed-Methane Reserves Involves Different Techniques," Oil & Gas Journal, Week of Oct. 9, 1989 (8 pages).
Steven W. Lambert, Stanley L. Graves and Arfon H. Jones, "Warrior Basin Drilling, Stimulation Covered," Oil & Gas Journal, Week of Oct. 9, 1989 (7 pages).
Steven W. Lambert and Stanley L. Graves, "Production Strategy Developed," Oil & Gas Journal, Week of Oct. 9, 1989 (4 pages).
Terry L. Logan, Western Basins Dictate Varied Operations, Oil & Gas Journal, Week of Oct. 9, 1989 (7 pages).
Vello A. Kuuskra, Charles M. Boyer II, and Richard A. McBane, "Steps to Assess Resource Economics Covered," Oil & Gas Journal, Week of Oct. 9, 1989 (6 pages).
Richard A. Counts, "Ownership Questions Can Stymie Development of Coalbed Methane," Oil & Gas Journal, Week of Oct. 9, 1989 (6 pages).
Richard A. Schraufnagel, Richard A. McBane and Vello A. Kuuskraa, "Coalbed Methane Development Faces Technology Gaps," Oil & Gas Journal, Week of Oct. 9, 1989 (7 pages).
"US Coalbed Methane Resource Estimates, Issues Aired," Oil & Gas Journal, Sep. 24, 2001 (2 pages).
Dr. Charles R. Nelson, "Coalbed Methane Potential of the U.S. Rocky Mountain Region," Gas Tips, Fall 2000 (9 pages).
Dr. Charles R. Nelson, "Changing Perceptions Regarding the Size and Production Potential of Coalbed Methane Resources," Gas TIPS, Summer 1999 (9 pages).
Ala. Coalbed Methane Production Hits Record, Coal Age, May 1998 (1 page).
Charles M. Boyer II, "Introduction," Gas Research Institute, Methane From Coal Seams Technology, Aug. 1993 (4 pages).
P.F. Steidl, "Evaluation of Induced Fractures Intercepted by Mining," Proceedings of the 1993 International Coalbed Methane Symposium, May 17-21, 1993 (12 pages).
W.P. Diamond, W.R. Bodden III, M.D. Zuber and R.A. Schraufnagel, "Measuring the Extent of Coalbed Gas Drainage After 10 Years of Production at the Oak Grove Pattern, Alabama," Proceedings of the 1989 Coalbed Methane Symposium, Apr. 17-20, 1989 (10 pages).
W.M. Merritts, W.N. Poundstone and B.A. Light, "Removing Methane (Degasification) From the Pittsburgh Coalbed in Northern West Virginia," Bureau of Mines RI 5977, 1962 (46 pages).
M.L. Skow, Ann G. Kim and Maurice Deul, "Creating a Safer Environment in U.S. Coal Mines," U.S. Bureau of Mines Impact Report, 1980 (56 pages).
Stephen W. Lambert, Michael A. Trevits, and Peter F. Steidl, "Vertical Borehole Design and Completion Practices Used to Remove Methane Gas From Mineable Coalbeds," U.S. Dept. of Energy, 1980 (173 pages).
M.A. Trevits, S.W. Lambert, P.F. Steidl and C.H. Elder, "Methane Drainage Through Small-Diameter Vertical Boreholes," Chapter 9 in U.S. Bureau of Mines Bulletin B687 entitled Methane Control Research: Summary of Results, 1964-80, 1988 (25 pages).
C.M. Boyer II and S.R. Reeves, "A Strategy for Coalbed Methane Production Development Part III: Production Operations," Proceedings of the 1989 Coalbed Methane Symposium, Apr. 17-20, 1989 (5 pages).
R.A. Mills and J.W. Stevenson, "History of Methane Drainage at Jim Walter Resources, Inc.," Proceedings of the 1991 Coalbed Methane Symposium, May 13-16, 1991 (9 pages).
Richard A. Schraufnagel, "Coalbed Methane Production," Chapter 15 of Hydrocarbons from Coal, American Association of Petroleum Geologists, 1993 (21 pages).
Curtis H. Elder, "Effects of Hydraulic Stimulation on Coalbeds and Associated Strata," Bureau of Mines RI 8260, 1977 (25 pages).
A Guide to Coalbed Methane Reservoir Engineering, published by Gas Research Institute, GRI-94/0397, pp. 2.11-2.12, 1996 (3 pages).
Well Performance Manual, Schlumberger, pp. 3-1 and 3-2, Aug. 1993 (4 pages).
Michael Zuber, "Coalbed Methane Engineering Methods," The Society of Petroleum Engineers, Oct. 2006 (161 pages).
James V. Mahoney, P.B. Stubbs, F.C. Schwerer III and F.X. Dobscha, "Effects of a No-Proppant Foam Stimulation Treatment on a Coal-Seam Degasification Borehole," Journal of Petroleum Technology, Nov. 1981 (9 pages).
S.J. Jeu, T.L. Logan and R.A. McBane, "Exploitation of Deeply Buried Coalbed Methane Using Different Hydraulic Fracturing Techniques in the Piceance Basin, Colorado and San Juan Basin New Mexico," Society of Petroleum Engineers, SPE 18253, copyright 1988 (11 pages).
Stephen E. Laubach, Carol M. Tremain and Walter B. Ayers, Jr., "Coal Fracture Studies: Guides for Coalbed Methane Exploration and Development," Journal of Coal Quality, vol. 10, No. 3, Jul.-Sep. 1991 (8 pages).
McCray, Arthur, et al., "*Oil Well Drilling Technology*," University of Oklahoma Press, 1959, Title Page, Copyright Page and pp. 315-319 (7 pages).
Berger, Bill, et al., "*Modern Petroleum: A Basic Primer of the Industry*," PennWell Books, 1978, Title Page, Copyright Page, and pp. 106-108 (5 pages).
Jones, Arfon H., et al., "*A Review of the Physical and Mechanical Properties of Coal with Implications for Coal-Bed Methane Well Completion and Production*," Rocky Mountain Association of Geologists, 1988, pp. 169-181 (13 pages).
Hartman, Howard L., et al., "*SME Mining Engineering Handbook*," Society for Mining, Metallurgy, and Exploration, Inc., 2nd Edition, vol. 2, 1992, Title Page, pp. 1946-1950 (6 pages).
Hassan, Dave, et al., "*Multi-Lateral Technique Lowers Drilling Costs, Provides Environmental Benefits*," Drilling Technology, Oct. 1999, pp. 41-47 (7 pages).
Ramaswamy, Gopal, "*Production History Provides CBM Insights*," Oil & Gas Journal, Apr. 2, 2001, pp. 49-50 and 52 (3 pages).
Chi, Weiguo, et al., "*Feasibility of Coalbed Methane Exploitation in China*," Horizontal Well Technology, Sep. 2001, Title Page and p. 74 (2 pages).
Nackerud Product Description, Harvest Tool Company, LLC, Received Sep. 27, 2001, 1 page.
Ramaswamy, Gopal, "*Advances Key for Coalbed Methane*," The American Oil & Gas Reporter, Oct. 2001, Title Page and pp. 71 and 73 (3 pages).
Stevens, Joseph C., "*Horizontal Applications or Coal Bed Methane Recovery*," Strategic Research Institute, 3rd Annual Coalbed and Coal Mine Methane Conference, Slides, Mar. 25, 2002, Title Page, Introduction Page and pp. 1-10 (13 pages).
Stayton, R.J. "Bob", "*Horizontal Wells Boost CBM Recovery*," Special Report: Horizontal and Directional Drilling, The American Oil and Gas Reporter, Aug. 2002, pp. 71, 73-75 (4 pages).
Eaton, Susan, "*Reversal of Fortune: Vertical and Horizontal Well Hybrid Offers Longer Field Life*," New Technology Magazine, Sep. 2002, pp. 30-31 (2 pages).
Mahony, James, "*A Shadow of Things to Come*," New Technology Magazine, Sep. 2002, pp. 28-29 (2 pages).

Documents Received from Third Party, Great Lakes Directional Drilling, Inc., Sep. 12, 2002, (12 pages).
Taylor, Robert W., et al. "*Multilateral Technologies Increase Operational Efficiencies in Middle East*," Oil and Gas Journal, Mar. 16, 1998, pp. 76-80 (5 pages).
Pasiczynk, Adam, "*Evolution Simplifies Multilateral Wells*," Directional Drilling, Jun. 2000, pp. 53-55 (3 pages).
Bell, Steven S. "*Multilateral System with Full Re-Entry Access Installed*," World Oil, Jun. 1, 1996, p. 29 (1 page).
Jackson, P., et al., "*Reducing Long Term Methane Emissions Resulting from Coal Mining*," Energy Convers. Mgmt, vol. 37, Nos. 6-8, 1996, pp. 801-806, (6 pages).
Breant, Pascal, "*Des Puits Branches, Chez Total : les puits multi drains*," Total XP-000846928, Exploration Production, Jan. 1999, 11 pages, including translation.
Chi, Weiguo, "*A feasible discussion on exploitation coalbed methane through Horizontal Network Drilling in China*," SPE 64709, Society of Petroleum Engineers (SPE International), Nov. 7, 2000, 4 pages.
B. Goktas et al., "*Performances of Openhole Completed and Cased Horizontal/Undulating Wells in Thin-Bedded, Tight Sand Gas Reservoirs*," SPE 65619, Society of Petroleum Engineers, Oct. 17-19, 2000 (7 pages).
Sharma, R., et al., "*Modelling of Undulating Wellbore Trajectories*," The Journal of Canadian Petroleum Technology, vol. 34, No. 10, XP-002261908, Oct. 18-20, 1993 pp. 16-24 (9 pages).
Balbinski, E.F., "*Prediction of Offshore Viscous Oil Field Performance*," European Symposium on Improved Oil Recovery, Aug. 18-20, 1999, 10 pages.
Notification of Transmittal of the International Search Report or the Declaration (PCT Rule 44.1) (3 pages) and International Search Report (7 pages) re International Application No. PCT/US 03/04771 mailed Jul. 4, 2003.
Notification of Transmittal of the International Search Report or the Declaration (per Rule 44.1) (3 pages) and International Search Report (4 pages) re International Application No. PCT/US 03/21626 mailed Nov. 6, 2003.
Notification of Transmittal of the International Search Report or the Declaration (PCT Rule 44.1) (3 pages) and International Search Report (5 pages) re International Application No. PCT/US 03/21891 mailed Nov. 13, 2003.
Notification of Transmittal of the International Search Report or the Declaration (PCT Rule 44.1) (3 pages) and International Search Report (4 pages) re International Application No. PCT/US 03/38383 mailed Jun. 2, 2004.
Notification of Transmittal of the International Search Report or the Declaration (PCT Rule 44.1) (3 pages) and International Search Report (5 pages) re International Application No. PCT/US 03/21627 mailed Nov. 5, 2003.
Notification of Transmittal of the International Search Report or the Declaration (PCT Rule 44.1) (3 pages) and International Search Report (4 pages) re International Application No. PCT/US 03/21628 mailed Nov. 4, 2003.
Notification of Transmittal of the International Search Report or the Declaration (PCT Rule 44.1) (3 pages) and International Search Report (5 pages) re International Application No. PCT/US 03/21750 mailed Dec. 5, 2003.
Notification of Transmittal of the International Search Report or the Declaration (PCT Rule 44.1) (3 pages) and International Search Report (3 pages) re International Application No. PCT/US 03/28137 mailed Dec. 19, 2003.
Notification of Transmittal of the International Search Report or the Declaration (PCT Rule 44.1) (3 pages) and International Search Report (5 pages) re International Application No. PCT/US 03/26124 mailed Feb. 4, 2004.
Notification of Transmittal of the International Search Report or the Declaration (PCT Rule 44.1) (3 pages) and International Search Report (6 pages) re International Application No. PCT/US 03/28138 mailed Feb. 9, 2004.
Notification of Transmittal of the International Search Report or the Declaration (PCT Rule 44.1) (3 pages) and International Search Report (6 pages) re International Application No. PCT/US-03/30126 mailed Feb. 27, 2004.
Smith, Maurice, "*Chasing Unconventional Gas Unconventionally*," CBM Gas Technology, New Technology Magazine, Oct./Nov. 2003, Title Page and pp. 1-4 (5 pages).
Gardes, Robert, "*A New Direction in Coalbed Methane and Shale Gas Recovery*," believed to have been first received at the Canadian Institute Coalbed Methane Symposium conference on Jun. 17, 2002, 7 pages.
Gardes, Robert, "*Under-Balanced Multi-Lateral Drilling for Unconventional Gas Recovery*," (to the best of Applicants' recollection, first received at the Unconventional Gas Revolution conference on Dec. 9, 2003, 30 pages.
Boyce, Richard G., "*High Resolution Seismic Imaging Programs for Coalbed Methane Development*," (to the best of Applicants' recollection, first received at the Unconventional Gas Revolution conference on Dec. 10, 2003), 28 pages.
Mazzella, Mark, et al., "*Well Control Operations on a Multiwell Platform Blowout*," WorldOil.com—Online Magazine Article, vol. 22, Part 1—pp. 1-7, Jan. 2001, and Part II, Feb. 2001, pp. 1-13 (20 pages).
Vector Magnetics, LLC, Case History, California, May 1999, "*Successful Kill of a Surface Blowout*," 1999, pp. 1-12.
Cudd Pressure Control, Inc, "*Successful Well Control Operations—A Case Study: Surface and Subsurface Well Intervention on a Multi-Well Offshore Platform Blowout and Fire*," 2000, pp. 1-17, http://www.cuddwellcontrol.com/literature/successful/successful_well.htm.
Purl, R., et al., "*Damage to Coal Permeability During Hydraulic Fracturing*," SPE 21813, 1991, Title Page and pp. 109-115 (8 pages).
U.S. Dept. of Energy—Office of Fossil Energy, "*Multi-Seam Well Completion Technology: Implications for Powder River Basin Coalbed Methane Production*," Sep. 2003, pp. 1-100, A-1 through A-10 (123 pages).
U.S. Dept. of Energy—Office of Fossil Energy, "*Powder River Basin Coalbed Methane Development and Produced Water Management Study*," Nov. 2002, pp. 1-111, A-1 through A-14 (213 pages).
Fletcher, Sam, "*Anadarko Cuts Route Under Canadian River Gorge*," Oil & Gas Journal, Jan. 5, 2004, pp. 28-30, (3 pages).
Kalinin, et al., Translation of Selected Pages from Ch. 4, Sections 4.1, 4.4, 4.4.1, 4.4.3, 11.2.2, 11.2.4 and 11.4, "*Drilling Inclined and Horizontal Well Bores*," Moscow, Nedra Publishers, 1997, 15 pages.
Kalinin, et al., Translation of Selected Pages from Ch. 4, Sections 4.2 (p. 135), 10.1 (p. 402), 10.4 (pp. 418-419), "*Drilling Inclined and Horizontal Well Bores*," Moscow, Nedra Publishers, 1997, 4 pages.
Arens, V. Zh., Translation of Selected Pages, "*Well-Drilling Recovery of Minerals*," Moscow, Nedra Publishers, 1986, 7 pages.
Jet Lavanway Exploration, "*Well Survey*," Key Energy Surveys, Nov. 2, 1997, 3 pages.
Precision Drilling, "*We Have Roots in Coal Bed Methane Drilling*," Technology Services Group, Published on or before Aug. 5, 2002, 1 page.
U.S. Dept. of Energy, "*New Breed of CBM/CMM Recovery Technology*," Jul. 2003, 1 page.
Ghiselin, Dick, "*Unconventional Vision Frees Gas Reserves*," Natural Gas Quarterly, Sep. 2003, 2 pages.
CBM Review, World Coal, "*US Drilling into Asia*," Jun. 2003, 4 pages.
Skrebowski, Chris, "*US Interest in North Korean Reserves*," Petroleum, Energy Institute, Jul. 2003, 4 pages.
Platt, "Method and System for Lining Multilateral Wells," U.S. Appl. No. 10/772,841, filed Feb. 5, 2004 (29 pages).
Palmer, Ian D., et al., "*Coalbed Methane Well Completions and Stimulations*," Chapter 14, Hydrocarbons From Coal, American Association of Petroleum Geologists, 1993, pp. 303-339.
Field, T.W., "*Surface to In-seam Drilling—The Australian Experience*," Undated, 10 pages.
Drawings included in CBM well permit issued to CNX stamped Apr. 15, 2004 by the West Virginia Department of Environmenal Protection (5 pages).
Website of Mitchell Drilling Contractors, "*Services: Dymaxion—Surface to In-seam*," http://www.mitchell drilling.com/dymaxion.htm, printed as of Jun. 17, 2004, 4 pages.

Website of CH4, "About Natural Gas—Technology," http://www.ch4.com.au/ng_technology.html, copyright 2003, printed as of Jun. 17, 2004, 4 pages.
Thomson, et al., "*The Application of Medium Radius Directional Drilling for Coal Bed Methane Extraction*," Lucas Technical Paper, copyrighted 2003, 11 pages.
U.S. Department of Energy, DE-FC26-01NT41148, "*Enhanced Coal Bed Methane Production and Sequestration of CO2 in Unmineable Coal Seams*" for Consol, Inc., accepted Oct. 1, 2001, 48 pages.
U.S. Department of Energy, "*Slant Hole Drilling*," Mar. 1999, 1 page.
Desai, Praful, et al., "*Innovative Design Allows Construction of Level 3 or Level 4 Junction Using the Same Platform*," SPE/Petroleum Society of CIM/CHOA 78965, Canadian Heavy Oil Association, 2002, pp. 1-11.
Bybee, Karen, "*Advanced Openhole Multilaterals*," Horizontal Wells, Nov. 2002, pp. 41-42.
Bybee, Karen, "*A New Generation Multilateral System for the Troll Olje Field*," Multilateral/Extended Reach, Jul. 2002, 2 pages.
Emerson, A.B., et al., "*Moving Toward Simpler, Highly Functional Multilateral Completions*," Technical Note, Journal of Canadian Petroleum Technology, May 2002, vol. 41, No. 5, pp. 9-12 (4 pages).
Moritis, Guntis, "*Complex Well Geometries Boost Orinoco Heavy Oil Producing Rates*," XP-000969491, Oil & Gas Journal, Feb. 28, 2000, pp. 42-46.
Themig, Dan, "*Multilateral Thinking*," New Technology Magazine, Dec. 1999, pp. 24-25.
Smith, R.C., et al., "*The Lateral Tie-Back System: The Ability to Drill and Case Multiple Laterals*," IADC/SPE 27436, Society of Petroleum Engineers, 1994, pp. 55-64, plus Multilateral Services Profile (1 page) and Multilateral Services Specifications (1 page).
Notification of Transmittal of the International Search Report or the Declaration (PCT Rule 44.1) (3 pages) and International Search Report (4 pages) re International Application No. PCT/US 03/13954 mailed Sep. 1, 2003.
Logan, Terry L., "*Drilling Techniques for Coalbed Methane*," Hydrocarbons From Coal, Chapter 12, Copyright 1993, Title Page, Copyright Page, pp. 269-285.
Hanes, John, "*Outbursts in Leichhardt Colliery: Lessons Learned*," International Symposium-Cum-Workshop on Management and Control of High Gas Emissions and Outbursts in Underground Coal Mines, Wollongong, NSW, Australia, Mar. 20-24, 1995, Title page, pp. 445-449.
Williams, Ray, et al., "*Gas Reservoir Properties for Mine Gas Emission Assessment*," Bowen Basin Symposium 2000, pp. 325-333.
Brown, K., et al., "*New South Wales Coal Seam Methane Potential*," Petroleum Bulletin 2, Department of Mineral Resources, Discovery 2000, Mar. 1996, pp. i-viii, 1-96.
Fipke, S., et al., "*Economical Multilateral Well Technology for Canadian Heavy Oil*," Petroleum Society, Canadian Institute of Mining, Metallurgy & Petroleum, Paper 2002-100, to be presented in Calgary Alberta, Jun. 11-13, 2002, pp. 1-11.
PowerPoint Presentation entitled, "Horizontal Coalbed Methane Wells," by Bob Stayton, Computalog Drilling Services, date is believed to have been in 2002 (39 pages).
Denney, Dennis, "*Drilling Maximum-Reservoir-Contact Wells in the Shaybah Field*," SPE 85307, pp. 60, 62-63, Oct. 20, 2003.
Notification of Transmittal of the International Search Report and the Written Opinion of the International Searching Authority, or the Declaration (3 pages), International Search Report (5 pages) and Written Opinion of the International Searching Authority (6 pages) re International Application No. PCT/US2004/012029 mailed Sep. 22, 2004.
Brunner, D.J. and Schwoebel, J.J., "Directional Drilling for Methane Drainage and Exploration in Advance of Mining," REI Drilling Directional Underground, World Coal, 1999, 10 pages.
Thakur, P.C., "A History of Coalbed Methane Drainage From United States Coal Mines," 2003 SME Annual Meeting, Feb. 24-26, Cincinnati, Ohio, 4 pages.
U.S. Climate Change Technology Program, "Technology Options for the Near and Long Term," 4.1.5 Advances in Coal Mine Methane Recovery Systems, pp. 162-164.
Notification of Transmittal of the International Search Report and the Written Opinion of the International Searching Authority, or the Declaration (3 pages), International Search Report (3 pages) and Written Opinion of the International Searching Authority (7 pages) re International Application No. PCT/US2004/017048 mailed Oct. 21, 2004.
Gardes, Robert, "Multi-Seam Completion Technology," Natural Gas Quarterly, E&P, Jun. 2004, pp. 78-81.
Baiton, Nicholas, "Maximize Oil Production and Recovery," Vertizontal Brochure, received Oct. 2, 2002, 4 pages.
Dreiling, Tim, McClelland, M.L., and Bilyeu, Brad, "Hoizontal and High Angle Air Drilling in the San Juan Basin, New Mexico," The Brief, published by Amoco and Chevron by Murphy Publishing, Inc., vol. 2, Issue 6, No. 54, Jun. 1996 (9 pages).
Fong, David K., Wong, Frank Y., and McIntyre, Frank J., "An Unexpected Benefit of Horizontal Wells on Offset Vertical Well Productivity in Vertical Miscible Floods," Canadian SPE/CIM/CANMET Paper No. HWC94-09, paper to be presented Mar. 20-23, 1994, Calgary, Canada, 10 pages.
Fischer, Perry A., "What's Happening in Production," World Oil, Jun. 2001, p. 27.
Website of PTTC Network News vol. 7, 1st Quarter 2001, Table of Contents, http://www.pttc.org/../news/v7n1nn4.htm printed Apr. 25, 2003, 3 pages.
Cox, Richard J.W., "Testing Horizontal Wells While Drilling Underbalanced," Delft University of Technology, Aug. 1998, 68 pages.
McLennan, John, et al., "Underbalanced Drilling Manual," Gas Research Institute, Chicago, Illinois, GRI Reference No. GRI-97/0236, copyright 1997, 502 pages.
The Need for a Viable Multi-Seam Completion Technology for the Powder River Basin, Current Practice and Limitations, Gardes Energy Services, Inc., Believed to be 2003 (8 pages).
Langley, Diane, "Potential Impact of Microholes Is Far From Diminutive," JPT Online, http://www.spe.org/spe/jpt/jps, Nov. 2004 (5 pages).
Consol Energy Slides, "Generating Solutions, Fueling Change," Presented at Appalachian E&P Forum, Harris Nesbitt Corp., Boston, Oct. 14, 2004 (29 pages).
Notification of Transmittal of the International Search Report and the Written Opinion of the International Searching Authority, or the Declaration (3 pages), International Search Report (3 pages), and Written Opinion of the International Searching Authority (5 pages) re International Application No. PCT/US2004/024518 mailed Nov. 10, 2004.
Schenk, Christopher J., "Geologic Definition and Resource Assessment of Continuous (Unconventional) Gas Accumulations—the U.S. Experience," Website, http://aapg.confex.com/aapg/cairo2002/techprogram/paper_66806.htm, printed Nov. 16, 2004 (1 page).
U.S. Department of Interior, U.S. Geological Survey, "Characteristics of Discrete and Basin-Centered Parts of the Lower Silurian Regional Oil and Gas Accumulation, Appalachian Basin: Preliminary Results From a Data Set of 25 oil and Gas Fields," U.S. Geological Survey Open-File Report 98-216, Website, http://pubs.usgs.gov/of/1998/of98-216/introl.htm, printed Nov. 16, 2004 (2 pages).
Zupanick, J., "Coalbed Methane Extraction," 28th Mineral Law Conference, Lexington, Kentucky, Oct. 16-17, 2003 (48 pages).
Zupanick, J., "CDX Gas—Pinnacle Project," Presentation at the 2002 Fall Meeting of North American Coal Bed Methane Forum, Morgantown, West Virginia, Oct. 30, 2002 (23 pages).
Lukas, Andrew, Lucas Drilling Pty Ltd., "Technical Innovation and Engineering Xstrata—Oaky Creek Coal Pty Limited," Presentation at Coal Seam Gas & Mine Methane Conference in Brisbane, Nov. 22-23, 2004 (51 pages).
Field, Tony, Mitchell Drilling, "Let's Get Technical—Drilling Breakthroughs in Surface to In-Seam in Australia," Presentation at Coal Seam Gas & Mine Methane Conference in Brisbane, Nov. 22-23, 2004 (20 pages).
Zupanick, Joseph A, "Coal Mine Methane Drainage Utilizing Multilateral Horizontal Wells," 2005 SME Annual Meeting & Exhibit, Feb. 28-Mar. 2, 2005, Salt Lake City, Utah (6 pages).
The Official Newsletter of the Cooperative Research Centre for Mining Technology and Equipment, CMTE News 7, "Tight-Radius Drilling Clinches Award," Jun. 2001, 1 page.

Listing of 174 References received from Third Party on Feb. 16, 2005 (9 pages).
Gardes Directional Drilling, "Multiple Directional Wells From Single Borehole Developed," Reprinted from Jul. 1989 edition of Offshore, Copyright 1989 by Penn Well Publishing Company (4 pages).
"Economic Justification and Modeling of Multilateral Wells," Economic Analysis, Hart's Petroleum Engineer International, 1997 (4 pages).
Mike Chambers, "Multi-Lateral Completions at Mobil Past, Present, and Future," presented at the 1998 Summit on E&P Drilling Technologies, Strategic Research Institute, Aug. 18-19, 1998 in San Antonio, Texas (26 pages).
David C. Oyler and William P. Diamond, "Drilling a Horizontal Coalbed Methane Drainage System From a Directional Surface Borehole," PB82221516, National Technical Information Service, Bureau of Mines, Pittsburgh, PA, Pittsburgh Research Center, Apr. 1982 (56 pages).
P. Corlay, D. Bossie-Codreanu, J.C. Sabathier and E.R. Delamaide, "Improving Reservoir Management With Complex Well Architectures," Field Production & Reservoir Management, World Oil, Jan. 1997 (5 pages).
Eric R. Skonberg and Hugh W. O'Donnell, "Horizontal Drilling for Underground Coal Gasification," presented at the Eighth Underground Coal Conversion Symposium, Keystone, Colorado, Aug. 16, 1982 (8 pages).
Gamal Ismail, A.S. Fada'q, S. Kikuchi, H. El Khatib, "Ten Years Experience in Horizontal Application & Pushing the Limits of Well Construction Approach in Upper Zakum Field (Offshore Abu Dhabi)," SPE 87284, Society of Petroleum Engineers, Oct. 2000 (17 pages).
Gamal Ismail, H. El-Khatib—ZADCO, Abu Dhabi, UAE, "Multi-Lateral Horizontal Drilling, Problems & Solutions Experienced Offshore Abu Dhabi," SPE 36252, Society of Petroleum Engineers, Oct. 1996 (12 pages).
C.M. Matthews and L.J. Dunn, "Drilling and Production Practices to Mitigate Sucker Rod/Tubing Wear-Related Failures in Directional Wells," SPE 22852, Society of Petroleum Engineers, Oct. 1991 (12 pages).
H.H. Fields, Stephen Krickovic, Albert Sainato, and M.G. Zabetakis,"Degasification of Virgin Pittsburgh Coalbed Through a Large Borehole," RI-7800, Bureau of Mines Report of Investigations/1973, United States Department of the Interior, 1973 (31 pages).
William P. Diamond, "Methane Control for Underground Coal Mines," IC-9395, Bureau of Mines Information Circular, United States Department of the Interior, 1994 (51 pages).
Technology Scene Drilling & Intervention Services, "Weatherford Moves Into Advanced Multilateral Well Completion Technology" and "Productivity Gains and Safety Record Speed Acceptance of UBS," *Reservoir Mechanics*, Weatherford International, Inc., 2000 Annual Report (2 pages).
"A Different Direction for CBM Wells," *W Magazine*, 2004 Third Quarter (5 pages).
Snyder, Robert E., "What's New in Production," *WorldOil Magazine*, Feb. 2005, [printed from the internet on Mar. 7, 2005], http://www.worldoil.com/magazine/MAGAZINE_DETAIL.asp?ART_ID=2507@MONTH_YEAR (3 pages).
Nazzal, Greg, "Moving Multilateral Systems to the Next Level, Strategic Acquisition Expands Weatherford's Capabilities," 2000 (2 pages).
Bahr, Angie, "Methane Draining Technology Boosts Safety and Energy Production," Energy Review, Feb. 4, 2005, Website: www.energyreview.net/storyviewprint.asp, printed Feb. 7, 2005 (2 pages).
Molvar, Erik M., "Drilling Smarter: Using Directional Drilling to Reduce Oil and Gas Impacts in the Intermountain West," Prepared by Biodiversity Conservation Alliance, Report issued Feb. 18, 2003, 34 pages.
King, Robert F., "Drilling Sideways—A Review of Horizontal Well Technology and Its Domestic Application," DOE/EIA-TR-0565, U.S. Department of Energy, Apr. 1993, 30 pages.
Santos, Helio, SPE, Impact Engineering Solutions and Jesus Olaya, Ecopetrol/ICP, "*No-Damage Drilling: How to Achieve this Challenging Goal?*," SPE 77189, Copyright 2002, presented at the IADC/SPE Asia Pacific Drilling Technology, Jakarta, Indonesia, Sep. 9-Nov. 2002, 10 pages.
Santos, Helio, SPE, Impact Engineering Solutions, "*Increasing Leakoff Pressure with New Class of Drilling Fluid*," SPE 78243, Copyright 2002, presented at the SPE/ISRM Rock Mechanics Conference in Irving, Texas, Oct. 20-23, 2002, 7 pages.
Franck Labenski, Paul Reid, SPE, and Helio Santos, SPE, Impact Solutions Group, "*Drilling Fluids Approaches for Control of Wellbore Instability in Fractured Formations*," SPE/IADC 85304, Society of Petroleum Engineers, Copyright 2003, presented at the SPE/IADC Middle East Drilling Technology Conference & Exhibition in Abu Chabi, UAE, Oct. 20-22, 2003, 8 pages.
P. Reid, SPE, and H. Santos, SPE, Impact Solutions Group, "*Novel Drilling, Completion and Workover Fluids for Depleted Zones: Avoiding Losses, Formation Damage and Stuck Pipe*," SPE/IADC 85326, Society of Petroleum Engineers, Copyright 2003, presented at the SPE/IADC Middle East Drilling Conference & Exhibition in Abu Chabi, UAE, Oct. 20-22, 2003, 9 pages.
Craig C. White and Adrian P. Chesters, NAM; Catalin D. Ivan, Sven Maikranz and Rob Nouris, M-I L.L.C., "*Aphron-based drilling fluid: Novel technology for drilling depleted formations*," World Oil, Drilling Report Special Focus, Oct. 2003, 5 pages.
Robert E. Snyder, "*Drilling Advances*," World Oil, Oct. 2003, 1 page.
U.S. Environmental Protection Agency, "*Directional Drilling Technology*," prepared for the EPA by Advanced Resources International under Contract 68-W-00-094, Coalbed Methane Outreach Program (CMOP), published Dec. 2002, Website: http://search.epa.gov/s97is.vts, printed Mar. 17, 2005, 13 pages.
"*Meridian Tests New Technology*," Western Oil World, Jun. 1990, Cover, Table of Contents and p. 13.
Clint Leazer and Michael R. Marquez, "*Short-Radius Drilling Expands Horizontal Well Applications*," Petroleum Engineer International, Apr. 1995, 6 pages.
Terry R. Logan, "*Horizontal Drainhole Drilling Techniques Used in Rocky Mountains Coal Seams*," Geology and Coal-Bed Methane Resources of the Northern San Juan Basin, Colorado and New Mexico, Rocky Mountain Association of Geologists, Coal-Bed Methane, San Juan Basin, 1988, pp. cover, 133-142.
Daniel J. Brunner, Jeffrey J. Schwoebel, and Scott Thomson, "*Directional Drilling for Methane Drainage & Exploration in Advance of Mining*," Website: http://www.advminingtech.com.au/Paper4.htm, printed Apr. 6, 2005, Copyright 1999, Last modified Aug. 7, 2002 (8 pages).
Karen Bybee, highlights of paper SPE 84424, "*Coalbed-Methane Reservoir Simulation: An Evolving Science*," by T.L. Hower, JPT Online, Apr. 2004, Website: http://www.spe.org/spe/jpt/jsp/jptpapersynopsis/0,2439,1104_11038_2354946_2395832,00.html, printed Apr. 14, 2005, 4 pages.
Kevin Meaney and Lincoln Paterson, "*Relative Permeability in Coal*," SPE 36986, Society of Petroleum Engineers, Copyright 1996, pp. 231-236.
Calendar of Events—Conference Agenda, Fifth Annual Unconventional Gas and Coalbed Methane Conference, Oct. 22-24, 2003, in Calgary Alberta, Website: http://www.csug.ca/cal/calc0301a.html, printed Mar. 17, 2005, 5 pages.
Tom Engler and Kent Perry, "*Creating a Roadmap for Unconventional Gas R&D*," Gas TIPS, Fall 2002, pp. 16-20.
CSIRO Petroleum—SIMEDWin, "Summary of SIMEDWin Capabilities," Copyright 1997-2005, Website: http://www.dpr.csiro.au/ourcapabilities/petroleumgeoengineering/reservoirengineering/projects/simedwin/assets/simed/index.html, printed Mar. 17, 2005, 10 pages.
Solutions From the Field, "*Coalbed Methane Resources in the Southeast*," Copyright 2004, Website: http://www.pttc.org/solutions/sol_2004/537.htm, printed Mar. 17, 2005, 7 pages.
Jeffrey R. Levine, Ph.D., "*Matrix Shrinkage Coefficient*," Undated, 3 pages.
G. Twombly, S.H. Stepanek, T.A. Moore, "*Coalbed Methane Potential in the Waikato Coalfield of New Zealand: A Comparison With Developed Basins in the United States*," 2004 New Zealand Petroleum Conference Proceedings, Mar. 7-10, 2004, pp. 1-6.

R.W. Cade, "*Horizontal Wells: Development and Applications," Presented at the Fifth International Symposium on Geophysics for Mineral*, Geotechnical and Environmental Applications, Oct. 24-28, 1993 in Tulsa, Oklahoma, Website: http://www.mgls.org/93Sym/Cade/cade.html, printed Mar. 17, 2005, 6 pages.
Solutions From the Field, "*Horizontal Drilling, A Technology Update for the Appalachian Basin*," Copyright 2004, Website: http://www.pttc.org/solutions/sol_2004/535.htm, printed Mar. 17, 2005, 6 pages.
R. Purl, J.C. Evanoff and M.L. Brugler, "*Measurement of Coal Cleat Porosity and Relative Permeability Characteristics*," SPE 21491, Society of Petroleum Engineers, Copyright 1991, pp. 93-104.
Peter Jackson, "*Drilling Technologies for Underground Coal Gasification*," IMC Geophysics Ltd., International UCG Workshop—Oct. 2003 (20 pages).
Notification of Transmittal of the International Search Report and the Written Opinion of the International Searching Authority, or the Declaration (3 pages), International Search Report (3 pages) and Written Opinion of the International Searching Authority (5 pages) re International Application No. PCT/US2005/002162 mailed Apr. 22, 2005.
Notification of Transmittal of the International Search Report and the Written Opinion of the International Searching Authority, or the Declaration (3 pages), International Search Report (3 pages) and Written Opinion of the International Searching Authority (5 pages) re International Application No. PCT/US2005/005289 mailed Apr. 29, 2005.
Notification of Transmittal of the International Search Report and the Written Opinion of the International Searching Authority, or the Declaration (3 pages), International Search Report (5 pages) and Written Opinion of the International Searching Authority (5 pages) re International Application No. PCT/US2004/036616 mailed Feb. 24, 2005.
Notification of Transmittal of International Preliminary Examination Report (1 page) and International Preliminary Examination Report (3 pages) for International Application No. PCT/US03/13954 mailed Apr. 14, 2005.
Notification of Transmittal of International Preliminary Examination Report (1 page) and International Preliminary Examination Report (5 pages) mailed Jan. 18, 2005 and Written Opinion (8 pages) mailed Aug. 25, 2005 for International Application No. PCT/US03/30126.
Notification of Transmittal of the International Search Report or the Declaration (3 pages) and International Search Report (5 pages) mailed Nov. 10, 2000 for International Application No. PCT/US99/27494.
Notification of Transmittal of International Preliminary Examination Report (1 page) and International Preliminary Examination Report (6 pages) mailed Apr. 2, 2001 and Written Opinion (7 pages) mailed Sep. 27, 2000 for International Application No. PCT/US99/27494.
Notification of Transmittal of the International Search Report or the Declaration (3 pages) and International Search Report (5 pages) mailed Jun. 6, 2002 for International Application No. PCT/US02/02051.
Notification of Transmittal of the International Search Report or the Declaration (3 pages) and International Search Report (6 pages) mailed Mar. 13, 2003 for International Application No. PC/US02/33128.
Notification of Transmittal of International Preliminary Examination Report (1 page) and International Preliminary Examination Report (3 pages mailed Apr. 22, 2004 and Written Opinion (6 pages) mailed Sep. 4, 2003 for International Application No. PCT/US02/33128.
Notes on Consol Presentation (by P. Thakur) made at IOGA PA in Pittsburgh, Pennsylvania on May 22, 2002 (3 pages).
Notification of Transmittal of the International Preliminary Report of Patentability (1 page) and International Preliminary Report on Patentability (12 pages) mailed Jan. 9, 2006 for International Application No. PCT/US2004/036616.
Notification Concerning Transmittal of International Preliminary Report on Patentability (Chapter 1 of the Patent Cooperation Treaty) (1 page), International Preliminary Report on Patentability (1 page), and Written Opinion of the International Searching Authority (7 pages) mailed Dec. 22, 2005 for International Application No. PCT/US2004/017048.
European Search and Examination Report, completed Dec. 5, 2005 for Application No. EP 05020737, 5 pages.
P.C. Thakur and W.N. Poundstone, "*Horizontal Drilling Technology for Advance Degasification*," Society of Mining Engineers of AIME, Preprint No. 79-113, For presentation at the 1979 AIME Annual Meeting, New Orleans, Lousiana, Feb. 18-22, 1979, Engineering Societies Library stamp dated Feb. 5, 1980, 11 pages.
Notification Concerning Transmittal of International Preliminary Report on Patentability (1 page), International Preliminary Report on Patentability (1 page), and Written Opinion of the International Searching Authority (5 pages) mailed Feb. 9, 2006 for International Application No. PCT/US2004/024518.
Wang Weiping, "*Trend of Drilling Technology Abroad*," Petroleum Drilling and Production Technology, 1995 (vol. 17), Issue 6, www.cnki.net, 8 pages, translation, original in Chinese.
Tver, David, *The Petroleum Dictionary*, 1980, p. 221.
Rennick et al., "*Demonstration of Safety Plugging of Oil Wells Penetrating Appalachian Coal Mines*," Bureau of Mines Coal Mine Health and Safety Research Program, Technical Progress Report—56, U.S. Department of the Interior, Jul. 1972, 25 pages.
George N. Aul and Joseph Cervik, "*Grouting Horizontal Drainage Holes in Coalbeds*," RI 8375, Bureau of Mines Report of Investigations, U.S. Department of the Interior, 1979, 21 pages.
Paul J. Componation, et al., "*Cleaning Out, Sealing and Mining Through Wells Penetrating Areas of Active Coal Mines in Northern West Virginia*," MESA Information Report 1052, U.S. Department of the Interior, 1977, 26 pages.
George S. Rice, "*Notes on the Prevention of Dust and Gas Explosions in Coal Mines*," Technical Paper 56, Bureau of Mines, Department of the Interior, copyright 1913, 12 pages.
George S. Rice, et al., "*Oil and Gas Wells Through Workable Coal Beds*," Bulletin 65, Petroleum Technology 7, Bureau of Mines, Department of the Interior, copyright 1913, 54 pages.
Notification of Transmittal of the International Preliminary Report on Patentability (1 page) and International Preliminary Report on Patentability (8 pages) for International Application No. PCT/US2005/002162 mailed May 3, 2006.
D. Nathan Meehan, "*Technology Vital For Horizontal Well Success*," Oil & Gas Journal, Dec. 11, 1995, 8 pages.
B.A. Tarr, A.F. Kuckes and M.V. Ac, "*Use of New Ranging Tool to Position a Vertical Well Adjacent to a Horizontal Well*," SPE Drilling Engineering, Jun. 1992, 7 pages.
William J. McDonald, Ph.D., John H. Cohen, and C. Mel Hightower, "*New Lightweight Fluids for Underbalanced Drilling*," presented at the U.S. Department of Energy (DOE) 1999 Oil & Gas Conference, Dallas, Texas, Jun. 28-30, 1999, 10 pages.
Philip C. Crouse, "*Application and Needs for Advanced Multilateral Technologies and Strategies*," Website: www.netl.doe.gov/publications/proceedings/97/97ng/ng97_pdf/NG2-5.pdf; presented at the U.S. Department of Energy (DOE) 1997 Natural Gas Conference on Mar. 24-27, 1997 in Houston, Texas, 9 pages.
Dan Themig, "*Multi-Laterals Providing New Options*," The American Oil & Gas Reporter, V. 39, No. 7, Jul. 1996, 4 pages.
Daniel D. Gleltman, "*Integrated Underbalanced Directional Drilling System*," Interim Report for Period of Performance Oct. 1, 1995-Feb. 14, 1996, DOE FETC Contract DE-AC21-95MC31103, Mar. 1997, 23 pages.
J.D. Gallivan, N.R. Hewitt, M. Olsen, J.M. Peden, D. Tehrani and A.A.P. Tweedie, "*Quantifying the Benefits of Multi-Lateral Producing Wells*," SPE 30441, Society of Petroleum Engineers, Inc., Copyright 1995, 7 pages.
C.A. Ehlig-Economides, G.R. Mowat and C. Corbett, "*Techniques for Multibranch Well Trajectory Design in the Context of a Three-Dimensional Reservoir Model*," SPE 35505, Society of Petroleum Engineers, Copyright 1996, 8 pages.
Stephen R. Dittoe, Albertus Retnanto, and Michael J. Economides, "*An Analysis of Reserves Enhancement in Petroleum Reservoirs with Horizontal and Multi-Lateral Wells*," SPE 37037, Society of Petroleum Engineers, Copyright 1996, 9 pages.
D.L. Boreck and M.T. Strever, "*Conservation of Methane from Colorado's Mined/Minable Coal Beds: A Feasibility Study*," Open-File Report 80-5, Colorado Geological Survey, Department of Natural Resources, Denver, Colorado, Oct. 1980, 101 pages.

B.G. kta and T. Ertekin, "*Implementation of a Local Grid Refinement Technique in Modeling Slanted, Undulating Horizontal and Multi-Lateral Wells*," SPE 56624, Society of Petroleum Engineers, Copyright 1999, 10 pages.
W.H. Leach Jr., "*New Technology for CBM Production*," Oil and Gas Investor, Opportunities in Coalbed Methane, Dec. 2002, 6 pages.
David Wagman, "*CBM Investors Keep Their Guard Up*," Oil and Gas Investor, Opportunities in Coalbed Methane, Dec. 2002, 5 pages.
Stephen D. Schwochow, "*CBM: Coming to a Basin Near You*," Oil and Gas Investor, Opportunities in Coalbed Methane, Dec. 2002, 7 pages.
"*White Paper: Guidebook on Coalbed Methane Drainage for Underground Coal Mines*," paper prepared under U.S. Environmental Protection Agency Cooperative Agreement No. CX824467-01 -0 with The Pennsylvania State University by Jan M. Mutmansky, Apr. 1999, 50 pages.
M.G. Zabetakis, Maurice Deul, and M.L. Skow, "*Methane Control in United States Coal Mines—1972*," Information Circular 8600, United States Department of the Interior, Bureau of Mines Information Circular/1973, 26 pages.
B. Goktas, "*A Comparative Analysis of the Production Characteristics of Cavity Completions and Hydraulic Fractures in Coalbed Methane Reservoirs*," Society of Petroleum Engineers, SPE 55600, Copyright 1999, 10 pages.
William P. Diamond and David C. Oyler, "*Drilling Long Horizontal Coalbed Methane Drainage Holes from a Directional Surface Borehole*," Society of Petroleum Engineers, SPE/DOE 8968, 1980, 6 pages.
Turgay Ertekin, Wonmo Sung, and Fred C. Schwerer, "*Production Performance Analysis of Horizontal Drainage Wells for the Degasification of Coal Seams*," Journal of Petroleum Technology, May 1988, 8 pages.
Patrick B. Tracy, "*Lateral Drilling Technology on UCG Project*," IADC/SPE 17237, IADC/SPE Drilling Conference, Copyright 1988, 10 pages.
P.S. Sarkar and J.M. Rajtar, "*Transient Well Testing of Coalbed Methane Reservoirs With Horizontal Wells*," SPE 27681, Society of Petroleum Engineers, Copyright 1994, 9 pages.
R.A. Schraufnagel, D.G. Hill and R.A. McBane, "*Coalbed Methane—A Decade of Success*," SPE 28581, Society of Petroleum Engineers, Copyright 1994, 14 pages.
J.R. Kelafant, C.M. Boyer, and M.D. Zuber, "*Production Potential and Strategies for Coalbed Methane in the Central Appalachian Basin*," SPE 18550, Society of Petroleum Engineers, Copyright 1988, 8 pages.
Ian Palmer, John McLennan, and Mike Kutas, "*Completions and Stimulations for Coalbed Methane Wells*," SPE 30012, Society of Petroleum Engineers, Copyright 1995, 13 pages.
John E. Jochen and Bradley M. Robinson, "*Survey of Horizontal Gas Well Activity*," SPE 35639, Society of Petroleum Engineers, Copyright 1996, 5 pages.
R.G. Jeffrey, J.R. Enever, J.H. Wood, J.P. Connors, S.K. Choi, K.T.A. Meaney, D.A. Casey, and R.A. Koenig, "*A Stimulation and Production Experiment in a Vertical Coal Seam Gas Drainage Well*," SPE 36982, Society of Petroleum Engineers, Copyright 1996, 7 pages.
Matt C. Rowan and Michael J. Whims, "*Multilateral Well Enhances Gas Storage Deliverability*," Oil & Gas Journal, Dec. 25, 1995, 4 pages.
Dan Themig, "*Planning and Evaluation are Crucial to Multilateral Wells*," Petroleum Engineer International, Jan. 1996, 3 pages.
Larry Comeau, Randy Pustanyk, Ray Smith and Ian Gilles, "*Lateral Tie-Back System Increases Reservoir Exposure*," World Oil, Jul. 1995, 5 pages.
J. Smith, M.J. Economides and T.P. Frick, "*Reducing Economic Risk in Areally Anisotropic Formations With Multiple-Lateral Horizontal Wells*," SPE 30647, Society of Petroleum Engineers, Copyright 1995, 14 pages.
Scott Thomson, Andrew Lukas, and Duncan McDonald, "*Maximising Coal Seam Methane Extraction through Advanced Drilling Technology*," Lucas, Technical Paper, Second Annual Australian Coal Seam & Mine Methane Conference, Feb. 19-20, 2003, 14 pages.
William P. Diamond and David C. Oyler, "*Directional Drilling for Coalbed Degasification in Advance of Mining*," Proceedings of the 2nd Annual Methane Recovery from Coalbeds Symposium, Apr. 18-20, 1979, 17 pages.
John L. Stalder, Gregory D. York, Robert J. Kopper, Carl M. Curtis and Tony L. Cole, and Jeffrey H. Copley, "*Multilateral-Horizontal Wells Increase Rate and Lower Cost Per Barrel in the Zuata Field, Faja, Venezuela*," SPE 69700, Society of Petroleum Engineers, Copyright 2001, 9 pages.
Brent Lowson, "*Multilateral-Well Planning*," Synopsis of SPE 39245, JPT, Jul. 1998, 4 pages.
A. Njaerheim, R. Rovde, E. Kvale, S.A. Kvamme, and H.M. Bjoerneli, "*Multilateral Well in Low-Productivity Zones*," Synopsis of SPE 39356, JPT, Jul. 1998, 4 pages.
S.W. Bokhari, A.J. Hatch, A. Kyei, O.C. Werngren, "*Improved Recovery from Tight Gas Sands with Multilateral Drilling*," Synopsis of SPE 38629, JPT, Jul. 1998, 4 pages.
S.K. Vij, S.L. Narasaiah, Anup Walia, and Gyan Singh, "*Adopting Multilateral Technology*," Synopsis of SPE 39509, JPT, Jul. 1998, 3 pages.
William P. Diamond, David C. Oyler, and Herbert H. Fields, "*Directionally Controlled Drilling to Horizontally Intercept Selected Strata, Upper Freeport Coalbed, Green County, PA*," Bureau of Mines Report of Investigations/1977, RI 8231, 1977, 25 pages.
David C. Oyler, William P. Diamond, and Paul W. Jeran, "*Directional Drilling for Coalbed Degasification*," Program Goals and Progress in 1978, Bureau of Mines Report of Investigations/1979, RI 8380, 1979, 17 pages.
United States Department of the Interior, "*Methane Control Research: Summary of Results, 1964-80*," Bureau of Mines Bulletin, Bulletin 687, 1988, 188 pages.
EPA, "*Identifying Opportunities for Methane Recovery at U.S. Coal Mines: Profiles of Selected Gassy Underground Coal Mines 1997-2001*," EPA Publication EPA 430-K-04-003, Jul. 2004, 202 pages.
Marshall DeLuca, "*Multilateral Completions on the Verge of Mainstream*," Offshore, Apr. 1997, 2 pages.
Bob Williams, "*Operators Unlocking North Slope's Viscous Oil Commerciality*," Oil & Gas Journal, Aug. 6, 2001, 5 pages.
James P. Oberkircher, "*The Economic Viability of Multilateral Wells*," IADC/SPE 59202, Society of Petroleum Engineers, Copyright 2000, 10 pages.
Jim Oberkircher, "*What is the Future of Multilateral Technology?*," World Oil, Jun. 2001, 3 pages.
Rick Von Flatern, "*Operators Are Ready For More Sophisticated Multilateral Well Technology*," Petroleum Engineer International, Jan. 1996, 4 pages.
Kyle S. Graves, "*Multiple Horizontal Drainholes Can Improve Production*," Oil & Gas Journal, OGJ Special, Feb. 14, 1994, 5 pages.
Guntis, Moritis, "*Sincor Nears Upgrading, Plateau Production Phase*," Oil & Gas Journal, Oct. 29, 2001, 1 page.
Guntis Moritis, "*Smart, Intelligent Wells*," Oil & Gas Journal, Apr. 2, 2001, 6 pages.
Craig Coull, "*Intelligent Completion Provides Savings for Snorre TLP*," Oil & Gas Journal, Apr. 2, 2001, 2 pages.
D.T. Vo and M.V. Madden, "*Performance Evaluation of Trilateral Wells: Field Examples*," SPE 28376, Society of Petroleum Engineers, copyright 1994, 16 pages.
Dean E. Gaddy, "*Pioneering Work, Economic Factors Provide Insights Into Russian Drilling Technology*," Oil & Gas Journal, Jul. 6, 1998, 3 pages.
"*Optimal Multilateral-Well Design for a Heavy-Oil Reservoir*," Synopsis of SPE 37554 by D.W. Boardman, JPT, Jul. 1997, 3 pages.
"*Multilateral-Well Completion-System Advances*," Synopsis of SPE 39125 by J.R. Longbottom et al., JPT, Jul. 1997, 3 pages.
"*Optimal Multilateral/Multibranch Completions*," Synopsis of SPE 38033 by Hironori Sugiyama et al., JPT, Jul. 1997, 5 pages.
"*Multilateral Experiences: IDD El Shargi North Dome Field (QATAR)*," Synopsis of SPE 37675 by J.R. Scofield et al., JPT, Jul. 1997, 3 pages.
"*Moving Toward the 'Intelligent Well'*," Synopsis of SPE 39126 by Clark E. Robison, JPT, Jul. 1997, 3 pages.
"*Short-Radius Laterals: An Operator's Experience*," Synopsis of SPE 37493 by C. Ellis et al., JPT, Jul. 1997, 3 pages.

"*Analyzing a Multilateral-Well Failure*," Synopsis of SPE 38268 by A. Ray Brister, JPT, Jul. 1997, 3 pages.
"*A New Concept for Multibranch Technology*," Synopsis of SPE 39123 by Mark Stracke et al., JPT, Jul. 1997, 3 pages.
"*Classification Clarifies Multilateral Options*," Synopsis of SPE 38493 by C. Hogg, JPT, Jul. 1997, 3 pages.
"*Infill Development With Multilateral-Well Technology*," Synopsis of SPE 38030 by Sau-Wai Wong et al., JPT, Jul. 1997, 3 pages.
Brad Califf and Denny Kerr, "*UPRC Completes First Quad-Lateral Well*," Petroleum Engineer International, Sep. 1993, 4 pages.
Jack Winton. "*Use of Multi-lateral Wells to Access Marginal Reservoirs*," Offshore, Feb. 1999, 3 pages.
J.R. Salas, P.J. Clifford and D.P. Jenkins, "*Brief Multilateral Well Performance Prediction*," JPT, Sep. 1996, 3 pages.
Mike R. Chambers, "*Multilateral Technology Gains Broader Acceptance*," Oil & Gas Journal, Nov. 23, 1998, 5 pages.
S. Ikeda, T. Takeuchi, and P.C. Crouse, "*An Investigative Study on Horizontal Well and Extended Reach Technologies With Reported Problem Areas and Operational Practice in North America and Europe*," IADC/SPE 35054, Society of Petroleum Engineers, Copyright 1996, 8 pages.
Greg Nazzal, "*Extended-Reach Wells Tap Outlying Reserves*," World Oil, Mar. 1993, 8 pages.
Bambang Tjondrodiputro, Harry Eddyarso and Kim Jones, "*How ARCO Drills High-Angle Wells Offshore Indonesia*," World Oil, Mar. 1993, 11 pages.
S. Hovda, et al., "*World's First Application of a Multilateral System Combining a Cased and Cemented Junction With Fullbore Access to Both Laterals*," SPE 36488, Society of Petroleum Engineers, Copyright 1996, 15 pages.
Robert A. Gardes, "*Micro-annulus Under-balanced Drilling of Multilateral Wells*," Offshore, May 1996, 4 pages.
Brent Lowson, "*Phillips Multilateral Features Several Firsts for North Sea*," Offshore, Feb. 1997, 2 pages.
J.R. Scofield, B. Laney and P. Woodard, "*Field Experience With Multi-Laterals in the Idd El Shargi North Dome Field (Qatar)*," SPE/IADC 37675, Society of Petroleum Engineers, Copyright 1997, 11 pages.
Jeremy Beckman, "*Coiled Tubing, Reamer Shoes Push Through Barriers in North Sea Wells*," Offshore, Feb. 1997, 1 page.
C.H. Fleming, "*Comparing Performance of Horizontal Versus Vertical Wells*," World Oil, Mar. 1993, 7 pages.
Larry A. Cress and Stephen W. Miller, "*Dual Horizontal Extension Drilled Using Retrievable Whipstock*," World Oil, Jun. 1993, 9 pages.
Guntis Moritis, "*Heavy Oil Expansions Gather Momentum Worldwide*," Oil & Gas Journal, Aug. 14, 1995, 6 pages.
K.W. Hart and L.V. Jankowski, "*The Application of Slant Hole Drilling in Development of Shallow Heavy Oil Deposits*," The Journal of Canadian Petroleum Teohnology, Jan.-Feb. 1984, Montreal, 6 pages.
Jeff Smith and Bob Edwards, "*Slant Rigs Offer Big Payoffs in Shallow Drilling*," Oil & Gas Journal, Mar. 30, 1992, 3 pages.
Ravil Gabdullinovich Salikhov, Evgeny Fedyorovich Dubrovin, and Vladimir Vladimirovich Sledkov, "*Cluster and Dual-Lateral Drilling Technologies Optimize Russian Well Production*," Oil & Gas Journal, Nov. 24, 1997, 7 pages.
Dean E. Gaddy, "*Inland Barge to Allow Cluster Drilling in Nigeria*," Oil & Gas Journal, Aug. 30, 1999, 7 pages.
Cliff Hogg, "*Comparison of Multilateral Completion Scenarios and Their Application*," SPE 38493, Society of Petroleum Engineers, Copyright 1997, 11 pages.
S.W. Bokhari, A.J. Hatch, A. Kyei and O.C. Wemgren, "*Improved Recoveries in the Pickerill Field from Multilateral Drilling into Tight Gas Sands*," SPE 38629, Society of Petroleum Engineers, Copyright 1997, 15 pages.
J.R. Longbottom, Dana Dale, Kevin Waddell, Scott Bruha, and John Roberts, "*Development, Testing, and Field Case Histories of Multilateral Well Completion Systems*," SPE 36994, Society of Petroleum Engineers, Copyright 1996, 16 pages.
E.J. Antczak, D.G.L. Smith, D.L. Roberts, Brent Lowson, and Robert Norris, "*Implementation of an Advanced Multi-Lateral System With Coiled Tubing Accessibility*," SPE/IADC 37673, Society of Petroleum Engineers, Copyright 1997, 9 pages.
H. Azoba, O. Akinmuladun, H. Rothenhofer, D. Kent and N. Nawfal, "*World Record Dual- and Tri-lateral Wells*," SPE/IADC 39240, Society of Petroleum Engineers, Copyright 1997, 6 pages.
R.W. Taylor and Rick Russell, "*Case Histories: Drilling and Completing Multilateral Horizontal Wells in the Middle East*," SPE/IADC 39243, Society of Petroleum Engineers, Copyright 1997, 14 pages.
D.K. Triolo and R.A. Mathes, "*Review of a Multi-Lateral Drilling and Stimulation Program*," SPE/IADC 39242, copyright 1997, Society of Petroleum Engineers, 13 pages.
John H. Perry, Leonard J. Prosser, Jr., Joseph Cervik, "*Methane Drainage from the Mary Lee Coalbed, Alabama, Using Horizontal Drilling Techniques*," SPE/DOE 8967, Society of Petroleum Engineers, May 18, 1980, 6 pages.
Gerald L. Finfinger, Leonard J. Prosser, and Joseph Cervik, "*Influence of Coalbed Characteristics and Geology on Methane Drainage*," SPE/DOE 8964, Society of Petroleum Engineers, May 18, 1980, 6 pages.
Hilmer Von Schonfeldt, B. Rao Pothini, George N. Aul and Roger L. Henderson, "*Production and Utilization of Coalbed Methane Gas in Island Creek Coal Company Mines*," SPE/DOE 10817, Society of Petroleum Engineers, May 16, 1982, 10 pages.
Joseph Cervik, H.H. Fields, and G.N. Aul, "*Rotary Drilling Holes in Coalbeds for Degasification*," RI 8097, Bureau of Mines Reporting of Investigations, 1975, 26 pages.
D.G. Masszi and A.A. Kahil, "*Coal Demethanation Principles and Field Experience*," The Journal of Canadian Petroleum Technology, Jul.-Aug. 1982, 4 pages.
Tobias W. Goodman, Joseph Cervik, and George N. Aul, "*Degasification Study From an Air Shaft in the Beckley Coalbed*," RI 8675, Bureau of Report of Investigations, 1982, 23 pages.
P.C. Thakur and H.D. Dahl, "*Horizontal Drilling—A Tool for Improved Productivity*," Mining Engineering, Mar. 1982, 3 pages.
P.C. Thakur and J.G. Davis II, "*How to Plan for Methane Control in Underground Coal Mines*," Mining Engineering, Oct. 1977, 5 pages.
A.B. Yost II and B.H. Javins, "*Overview of Appalachian Basin High-Angle and Horizontal Air and Mud Drilling*," SPE 23445, Society of Petroleum Engineers, Oct. 22, 1991, 14 pages.
Pramod C. Thakur, "*Methane Flow in the Pittsburgh Coal Seam*," Third International Mine Ventilation Congress, England, U.K., Jun. 13-19, 1984, 17 pages.
Chapter 10 by Pramod C. Thakur, "*Methane Control for Longwall Gobs*," Longwall-Shortwall Mining, State of the Art by R.V. Ramani, published by New York: Society of Mining Engineers of the American Institute of Mining, Metallurgical, and Petroleum Engineers, 1981, 7 pages.
Pramod C. Thakur, Stephen D. Lauer, and Joseph Cervik, "*Methane Drainge With Cross-Measure Boreholes on a Retreat Longwall Face*," Preprint No. 83-398, Society of Milling Engineers of AIME, for presentation at the SME-AIME Fall Meeting and Exhibit, Salt Lake City, Utah, Oct. 19-21, 1983, 14 pages.
Warren F. Dobson and Daniel R. Seelye, "*Mining Technology Assists Oil Recovery from Wyoming Field*," SPE 9418, Society of Petroleum Engineers of AIME, Copyright 1980, 7 pages.
T.L. Logan, J.J. Schwoebel and D.M. Homer, "*Application of Horizontal Drainhole Drilling Technology for Coalbed Methane Recovery*," SPE/DOE 16409, Society of Petroleum Engineers/U.S. Department of Energy, Copyright 1997, 12 pages.
Samuel O. Osisanya and Robert F. Schaffitzel, "*A Review of Horizontal Drilling and Completion Techniques for Recovery of Coalbed Methane*," SPE 37131, Society of Petroleum Engineers, Copyright 1996, 13 pages.
S.D. Joshi, "*A Review of Horizontal Well and Drainhole Technology*," SPE 16868, Society of Petroleum Engineers, Copyright 1987, 17 pages.
R. Bitto, A.B. Henderson and L. Broussard, "*Recent Case Histories of New Well Applications for Horizontal Drilling*," SPE 21262, Society of Petroleum Engineers, Copyright 1990, 12 pages.
M.R. Konopczynski, John Hughes and J.E. Best, "*A Novel Approach to Initiating Multi-Lateral Horizontal Wells*," SPE/IADC 29385, Society of Petroleum Engineers, Copyright 1996, 11 pages.
Kelly Falk and Craig McDonald, "*An Overview of Underbalanced Drilling Applications in Canada*," SPE 30129, Society of Petroleum Engineers, Copyright 1995, 9 pages.

"*Evolution Toward Simpler, Less Risky Multilateral Wells*," World Oil, prepared from paper SPE/IADC 67825 by Adam Pasicznyk, Jun. 2001, 8 pages.
"*How Multilateral Boreholes Impact Ultimate Recovery Strategies*," Offshore, Jul. 1997, 6 pages.
"*Trilateral Horizontal Wells Add 10 Million bbl for Unocal*," Offshore, Dec. 1993, 2 pages.
Nicholas P. Chironis, "*New Borehole Techniques Offer Hope for Gassy Mines*," Coal Age, Jan. 1973, 4 pages.
A. Retnanto, T.P. Frick, C.W. Brand, and M.J. Economides, "*Optimal Configurations of Multiple-Lateral Horizontal Wells*," SPE 35712, Society of Petroleum Engineers, Copyright 1996, 8 pages.
T.L. Logan, "*Horizontal Drainhole Drilling Techniques Used for Coal Seam Resource Exploitation*," SPE 18254, Society of Petroleum Engineers, Copyright 1988, 13 pages.
David Hill, Eric Neme, Christine Enlig-Economides and Miguel Mollinedo, "*Reentry Drilling Gives New Life to Aging Fields*," Oilfield Review, Autumn 1996, 14 pages.
R.L. Thoms and R.M. Gehle, "*Feasibility of Controlled Solution Mining From Horizontal Wells*," Solution Mining Research Institute, Oct. 24-27, 1993, 8 pages.
"*World's First Trilateral Horizontal Wells on Stream*," Oil & Gas Journal, Nov. 29, 1993, 2 pages.
Margaret A. Adams, Jeanne L. Hewitt and Rodney D. Malone, "*Coalbed Methane Potential of the Appalachians*," SPE/DOE 10802, Society of Petroleum Engineers, Copyright 1982, 10 pages.
F.C. Schwerer and A.M. Pavone, "*Effect of Pressure-Dependent Permeability on Well-Test Analyses and Long-Term Production of Methane From Coal Seams*," SPE/DOE/GRI 12857, Society of Petroleum Engineers, Copyright 1984, 10 pages.
Stephen Krickovic and J.D. Kalasky, "*Methane Emission Rate Study in a Deep Pocahontas No. 3 Coalbed Mine in Conjunction With Drilling Degasification Holes in the Coalbed*," RI-7703, Bureau of Mines Report of Investigations/1972, United States Department of the Interior, 1972, 15 pages.
H.H. Fields, Joseph Cervik, and T.W. Goodman, "*Degasification and Production of Natural Gas From an Air Shaft in the Pittsburgh Coalbed*," RI-8173, Bureau of Mines Report of Investigations/1976, United States Department of the Interior, 1976, 28 pages.
Gerald L. Finfinger and Joseph Cervik, "*Drainage of Methane From the Overlying Pocahontas No. 4 Coalbed From Workings in the Pocahontas No. 3 Coalbed*," RI-8359, Bureau of Mines Report of Investigations/1979, United States Department of the Interior, 1979, 19 pages.
Gerald L. Finfinger and Joseph Cervik, "*Review of Horizontal Drilling Technology for Methane Drainage From U.S. Coalbeds*," IC-8829, Bureau of Mines Information Circular/1980, United States Department of the Interior, 1980, 24 pages.
Andre P. Jourdan and Guy A. Baron, "*Elf Drills 1,000 + Ft Horizontally*," Petroleum Engineer International, Sep. 1981, 4 pages.
P.F. Conti, "*Controlled Horizontal Drilling*," SPE/IADC 18708, Society of Petroleum Engineers, Copyright 1989, 6 pages.
Armando R. Navarro, "*Innovative Techniques Cut Costs in Wetlands Drilling*," Oil & Gas Journal, Oct. 14, 1991, 4 pages.
Victor M. Luhowy and Peter D. Sametz, "*Horizontal Wells Prove Effective in Canadian Heavy-Oil Field*," Oil & Gas Journal, Jun. 28, 1993, 6 pages.
D. Lane Becker, "*Project Management Improved Multiwell Shallow Gas Development*," Oil & Gas Journal, Oct. 16, 1995, 5 pages.
Mike R. Chambers, "*Junction Design Based on Operational Requirements*," Oil & Gas Journal, Dec. 7, 1998, 7 pages.
A.J. Branch, et al., "*Remote Real-Time Monitoring Improves Orinoco Drilling Efficiency*," Oil & Gas Journal, May 28, 2001, 6 pages.
D. Keith Murray, "*Deep Coals Hold Big Part of Resource*," The American Oil & Gas Reporter, May 2002, 8 pages.
Nestor Rivera, et al., "*Multilateral, Intelligent Well Completion Benefits Explored*," Oil & Gas Journal, Apr. 14, 2003, 10 pages.
Handbook on Coal Bed Methane Produced Water: Management and Beneficial Use Alternatives, prepared by all Consulting, Jul. 2003, 321 pages.
Nikola Maricic, "*Parametric and Predictive Analysis of Horizontal Well Configurations for Coalbed Methane Reservoirs in Appalachian Basin*," Thesis, West Virginia University, Department of Petroleum and Natural Gas Engineering, 2004, 162 pages.
Nikola Maricic, Shahab D. Mohaghegh, and Emre Artun, "*A Parametric Study on the Benefits of Drilling Horizontal and Multilateral Wells in Coalbed Methane Reservoirs*," SPE 96018, Society of Petroleum Engineers, Copyright 2005, 8 pages.
D.P. Schlick and J. W. Stevenson, "*Methane Degasification Experience at Jim Walter's*," Proceedings of the Twelfth Annual Institute on Coal Mining Health, Safety and Research, Aug. 25-27, 1981,9 pages.
P.C. Thakur, "*Optimum Methane Drainage in Gassy Coal Mines*," 2003 SME Annual Meeting, copyright 2003 by SME, 4 pages.
Global Methane and the Coal Industry: A Two-Part Report on Methane Emissions from the Coal Industry and Coalbed Methane Recovery and Use, Coal Industry Advisory Board, International Energy Agency, copyright 1994, 72 pages.
Paul F. Conti and Michael Schumacher, "Solution Mining in the Nineties," Presented at the Fall 1991 meeting of the Solution Mining Research Institute, Oct. 27-30, 1991, 11 pages.
Notification of Transmittal of the International Preliminary Report on Patentability (1 page), International Preliminary Report on Patentability (7 pages) and Amended Sheets (9 pages) for International Application No. PCT/US2004/012029 mailed Aug. 11, 2005.
Notification Concerning Transmittal of International Preliminary Report on Patentability (1 page), International Preliminary Report on Patentability (1 page), and Written Opinion (5 pages) for International Application No. PCT/US2005/005289 mailed Sep. 8, 2006.
Invitation to Pay Additional Fees (2 pages) and Annex to Form PCT/ISA/206 Communication Relating to the Results of the Partial International Search (3 pages) for International Application No. PCT/US2006/021057 mailed Sep. 11, 2006.
Kalinin, D.G., et al., Translation of Selected Pages, "Boring Direction and Horizontal Wells," Moscow, "Nedra", 1997, p. 11-12, 148-152 (15 pages).
Evaluation of Coalbed Methane Well Types in the San Juan Basin, prepared by Malkewicz Hueni Associates, Inc. for The Bureau of Land Management, Mar. 2004, 23 pages.
Robert William Chase, "*Degasification of Coal Seams Via Vertical Boreholes: A Field and Computer Simulation Study*," Thesis in Petroleum and Natural Gas Engineering, Mar. 1980, 174 pages.
L.Z. Shuck and J. Pasini III, "In Situ Gasification of Eastern Coals," presented at the proceedings of the Coal Processing and Conversion Symposium, Jun. 1-3, 1976, Morgantown, West Virginia, 16 pages.
Terry L. Logan, "Application of Medium Radius Horizontal Drainhole Drilling Technology for Underground Coal Gasification," presented at 13$^{th}$ Annual Underground Coal Gasification Symposium, Aug. 24-26, 1987, Laramie, Wyoming, 10 pages.
S.R. Lindblom and V.E. Smith, "Rocky Mountain 1 Underground Coal Gasification Test," Hanna, Wyoming, Groundwater Evaluation, DOE Grant No. DE-FG21-88MC25038, Final Report, Jun. 10, 1988-Jun. 30, 1993, 5 pages.
Coal-Bed Methane: Potential and Concerns, U.S. Department of the Interior, U.S. Geological Survey, USGS Fact Sheet FS-123-00, Oct. 2000, 2 pages.
Horizontal and Multilateral Wells, Society of Petroleum Engineers, website: http://www.spe.org/spe/jsp/basic_pf/0..1104_1714_1003974,00.html, printed Dec. 27, 2006, 5 pages.
Notification of Transmittal of the International Search Report and the Written Opinion of the International Searching Authority, or the Declaration (3 pages), International Search Report (7 pages), and Written Opinion of the International Searching Authority (7 pages) for International Application No. PCT/US2006/021057 dated Jan. 4, 2007.
I.D. Palmer, M.J. Mavor, J.L. Spitler and R.F. Volz, "*Openhole Cavity Completions in Coalbed Methane Wells in the San Juan Basin*," Journal of Petroleum Technology, vol. 45, No. 11, Nov. 1993, 11 pages.
V.S. Orlov, et al., "*Methods for Simultaneous Segregated Production from Multiple Formations Using Single Well*," Series Petroleum Engineering, Moscow, Aurdiomeogi, 1976, translated pp. 6-11, 28-29 and 36-37, 15 pages.
Kalinin A.G. et al., "*Boring of Slanted and Horizontal Well Bores*," Moskva, Nedra, 1997, pp. 453-458, Sections 11.2, 11.2.2, and 11.2.3, 10 pages.

Website: http://biz.yahoo.com/bw/080602/20080602006520.html?.v=1&printer=1, Press Release, CDX Gas Settles Patent Litigation With CNX Gas, Monday, Jun. 2, 2008, 5:00 p.m. ET, printed Jun. 4, 2008 (2 pages).
"*Local firm signs contract to develop Soviet fields*," The Daily Advertiser, December (1 page).
Zupanick, U.S. Patent Application, entitled, "Method and System for Accessing Subterranean Deposits From the Surface and Tools Therefor," U.S. Appl. No. 12/313,652, filed Nov. 21, 2008.
Johnson, Rick et al. "Underbalanced Drilling Design Maximizes Coal Bed Methane Recoveries", CDX Gas, LLC, Aug. 2008, 6 pages.
Communication of Partial European Search Report (1 page), Partial European Search Report (2 pages), Lack of Unity of Invention Sheet B (2 pages) and Annex to the European Search Report (1 page) for Application No. EP 07 02 1409 dated Aug. 6, 2008.
T. Beims and C. Strunk, "*Capital, Technology Suppliers Pulling New Tricks From the Hat as Industry Hits High Gear*," The American Oil & Gas Reporter, Mar. 1997 (8 pages).
B. Campbell, "*Directional Driller Discovers Future in Technology*," The American Oil & Gas Reporter, Jul. 1991 (4 pages).
"*Economic Justification and Modeling of Multilateral Wells*," in "Multilateral Technology: Taking Horizontal Wells to the Next Level"—a supplement to Hart's Petroleum Engineer, International, 1997 (5 pages).
R. Gardes, "*New Radial Drilling Technology Applied to Recovering Cores*," The American Oil & Gas Reporter, Apr. 1993 (5 pages).
Gardes Energy Services, Inc., Map of Drilled Well Locations (1 page).
"*Gardes Drilling redefines improved recovery*," Improved Recovery Week, vol. 1, No. 21, Jul. 1992 (3 pages).
R. Gardes, "*Micro-Annulus Underbalanced Drilling of Multilaterals*," 4th Annual North American Conference on Coiled Tubing, Feb. 5-6, 1996 (23 pages).
R. Gardes, "*The Evolution of Horizontal Multi-Lateral Underbalanced Drilling Technology*," Society of Independent Professional Earth Scientists Newsletter, vol. 38, Aug. 2000 (3 pages).
R. Gardes, *Underbalanced Drilling of Multilateral Horizontal Wells*, 8th Annual International Conference on Horizontal Well Technologies & Applications, Sep. 9-11, 1996 (7 pages).
"*Lafayette firm set to do business with Soviet Union*," Advertiser, Lafayette, La, Aug. 1990 (1 page).
L. LeBlanc, "*Beyond extended-read, horizontal drilling?*," Drilling & Production, May 1992 (1 page).
"*Local firm signs contract to develop Soviet fields*," The Daily Advertiser, Dec. (1 page).
"*History Repeats Itself: Multilateral Technology Development Parallels That of Horizontal Wells*," in "Multilateral Technology: Taking Horizontal Wells to the Next Level"—a supplement to Hart's Petroleum Engineer International, (5 pages).
"*New Enabling Technologies Spur Multilateral Use*," in "Multilateral Technology: Taking Horizontal Wells to the Next Level"—a supplement to Hart's Petroleum Engineer International, (5 pages).
"*New tools, techniques reduce high-angle drilling costs*," Offshore, Nov. 1989 (3 pages).
R. Gardes, "*Micro-annulus under-balanced drilling of multilateral wells*," Offshore, May 1996 (4 pages).
"*Multiple directional wells from single borehole developed*," Offshore, reprint from Jul. 1989 (4 pages).
"*Soviet joint venture pace continues to sizzle*," Oil & Gas Journal, week of Jun. 25, 1990 (3 pages).
"*Operators Team Up to Climb Learning Curve Together*," in "Multilateral Technology: Taking Horizontal Wells to the Next Level"—a supplement to Hart's Petroleum Engineer International (4 pages).
"*Radial Coring Reduces Sample Contamination, Evaluates Old Wells*," Hart's Petroleum Engineer International, Jun. 1994 (4 pages).
"*The Fate of Award Winners is a Credit to Their Judges*," Hart's Petroleum Engineer International, Apr. 1996 (3 pages).
S. R. Reeves and S. H. Stevens, "*$CO_2$ Sequestration*," World Coal, Dec. 2000 (4 pages).
"*Successful Completions Raise Operators' Confidence*," in "Multilateral Technology: Taking Horizontal Wells to the Next Level"—a supplement to Hart's Petroleum Engineer International (5 pages).
Extended European Search Report, Application No. 07021409.3-2315 dated Oct. 30, 2008 (8 pages).
Zupanick, U.S. Patent Application, entitled, "Method and System for Accessing Subterranean Deposits From the Surface and Tools Therefor," U.S. Appl. No. 12/313,652, Nov. 21, 2008.
The State Intellectual Property Office of the People's Republic of China, "The First Office Action", Chinese Appl. No. 99815570.5, dated Apr. 29, 2005 (6 pages).
Ron Weber, "Examination Report", Australian Appl. No. 2011200364, dated Dec. 22, 2011 (2 pages).
Jeffrey Butler, "Examination Report", Canadian Appl. No. 2,661,725, dated Jun. 6, 2011 (3 pages).
The State Intellectual Property Office of The People's Republic of China, "Third Office Action", Application No. 200710152916.9, issued on Aug. 1, 2012 (4 pages).

METHOD AND SYSTEM FOR ACCESSING SUBTERRANEAN DEPOSITS FROM THE SURFACE

RELATED APPLICATIONS

This application is a continuation of U.S. application Ser. No. 11/312,041, filed Dec. 20, 2005 now abandoned by Joseph A. Zupanick and entitled METHOD AND SYSTEM FOR ACCESSING SUBTERRANEAN DEPOSITS FROM THE SURFACE, which is a continuation of U.S. application Ser. No. 10/641,856, filed Aug. 15, 2003 by Joseph A. Zupanick and entitled METHOD AND SYSTEM FOR ACCESSING SUBTERRANEAN DEPOSITS FROM THE SURFACE, now U.S. Pat. No. 6,976,533, which is a continuation of U.S. application Ser. No. 10/256,412, filed Sep. 26, 2002 by Joseph A. Zupanick and entitled METHOD AND SYSTEM FOR ACCESSING SUBTERRANEAN DEPOSITS FROM THE SURFACE, now U.S. Pat. No. 6,679,322, which is a continuation of U.S. application Ser. No. 09/885,219, filed Jun. 20, 2001 by Joseph A. Zupanick and entitled METHOD AND SYSTEM FOR ACCESSING SUBTERRANEAN DEPOSITS FROM THE SURFACE, now U.S. Pat. No. 6,561,288, which is a continuation of U.S. application Ser. No. 09/444,029 filed Nov. 19, 1999 by Joseph A. Zupanick and entitled DRAINAGE PATTERN WITH INTERSECTING WELLS DRILLED FROM SURFACE, now U.S. Pat. No. 6,357,523, which is a continuation-in-part of U.S. application Ser. No. 09/197,687 filed Nov. 20, 1998 by Joseph A. Zupanick and entitled METHOD FOR PRODUCTION OF GAS FROM A COAL SEAM, now U.S. Pat. No. 6,280,000. U.S. application Ser. No. 10/641,856, now U.S. Pat. No. 6,976,533, is also a continuation-in-part of Ser. No. 10/630,345 filed Jul. 29, 2003 by Joseph A. Zupanick, et al, and entitled METHOD AND SYSTEM FOR ACCESSING SUBTERRANEAN DEPOSITS FROM THE SURFACE AND TOOLS THEREFOR, which is a continuation-in-part of U.S. application Ser. No. 10/165,627 filed Jun. 7, 2002 by Joseph A. Zupanick and entitled METHOD AND SYSTEM FOR ACCESSING SUBTERRANEAN DEPOSITS FROM THE SURFACE, now U.S. Pat. No. 6,668,918 which is a continuation of Ser. No. 09/789,956 filed Feb. 20, 2001 by Joseph A. Zupanick and entitled METHOD AND SYSTEM FOR ACCESSING SUBTERRANEAN DEPOSITS FROM THE SURFACE, now U.S. Pat. No. 6,478,085, which is a divisional of Ser. No. 09/444,029 filed Nov. 19, 1999 by Joseph A. Zupanick and entitled DRAINAGE PATTERN WITH INTERSECTING WELLS DRILLED FROM SURFACE, now U.S. Pat. No. 6,357,523, which is a continuation-in-part of U.S. application Ser. No. 09/197,687 filed Nov. 20, 1998 by Joseph A. Zupanick and entitled METHOD FOR PRODUCTION OF GAS FROM A COAL SEAM, now U.S. Pat. No. 6,280,000.

This application is a continuation of U.S. application Ser. No. 10/630,345 entitled METHOD AND SYSTEM FOR ACCESSING SUBTERRANEAN DEPOSITS FROM THE SURFACE AND TOOLS THEREFOR, filed Jul. 29, 2003, published Jun. 10, 2004 as U.S. Publication Number US-2004-0108110-A1, which is a continuation-in-part of U.S. application Ser. No. 10/165,627 entitled METHOD AND SYSTEM FOR ACCESSING SUBTERRANEAN DEPOSITS FROM THE SURFACE, filed Jun. 7, 2002, issued Dec. 30, 2003 as U.S. Pat. No. 6,668,918, which is a continuation of U.S. application Ser. No. 09/789,956, entitled METHOD AND SYSTEM FOR ACCESSING SUBTERRANEAN DEPOSITS FROM THE SURFACE, filed Feb. 20, 2001, issued Nov. 12, 2002 as U.S. Pat. No. 6,478,085, which is a divisional of U.S. application Ser. No. 09/444,029, entitled DRAINAGE PATTERN WITH INTERSECTING WELLS DRILLED FROM SURFACE, filed Nov. 19, 1999, issued Mar. 19, 2002 as U.S. Pat. No. 6,357,523, which is a continuation-in-part of U.S. application Ser. No. 09/197,687, entitled METHOD FOR PRODUCTION OF GAS FROM A COAL SEAM USING INTERSECTING WELL BORES, filed Nov. 20, 1998, issued Aug. 28, 2001 as U.S. Pat. No. 6,280,000.

U.S. application Ser. No. 10/630,345 is also a continuation-in-part of U.S. application Ser. No. 09/774,996, entitled METHOD AND SYSTEM FOR ACCESSING SUBTERRANEAN ZONES FROM A LIMITED SURFACE AREA, filed Jan. 30, 2001, issued Dec. 16, 2003 as U.S. Pat. No. 6,662,870.

U.S. application Ser. No. 10/630,345 is also a continuation-in-part of U.S. application Ser. No. 10/123,561, entitled METHOD AND SYSTEM FOR ACCESSING SUBTERRANEAN ZONES FROM A LIMITED SURFACE AREA, filed Apr. 15, 2002, issued Aug. 12, 2003 as U.S. Pat. No. 6,604,580, which is: (i) a divisional of U.S. application Ser. No. 09/773,217, entitled METHOD AND SYSTEM FOR ACCESSING SUBTERRANEAN ZONES FROM A LIMITED SURFACE AREA, filed Jan. 30, 2001, issued Jul. 30, 2002 as U.S. Pat. No. 6,425,448 and (ii) a continuation-in-part of U.S. application Ser. No. 09/885,219, entitled METHOD AND SYSTEM FOR ACCESSING SUBTERRANEAN DEPOSITS FROM THE SURFACE, filed Jun. 20, 2001, issued May 13, 2003 as U.S. Pat. No. 6,561,288, which is a continuation of U.S. application Ser. No. 09/444,029, entitled DRAINAGE PATTERN WITH INTERSECTING WELLS DRILLED FROM SURFACE, filed Nov. 19, 1999, issued Mar. 19, 2002 as U.S. Pat. No. 6,357,523, which is a continuation-in-part of U.S. application Ser. No. 09/197,687, entitled METHOD FOR PRODUCTION OF GAS FROM A COAL SEAM USING INTERSECTING WELL BORES, filed Nov. 20, 1998, issued Aug. 28, 2001 as U.S. U.S. Pat. No. 6,280,000.

U.S. application Ser. No. 10/630,345 is also a continuation-in-part of U.S. application Ser. No. 10/046,001, entitled METHOD AND SYSTEM FOR MANAGEMENT OF BY-PRODUCTS FROM SUBTERRANEAN ZONES, filed Oct. 19, 2001, issued Jan. 27, 2004 as U.S. Pat. No. 6,681,855.

U.S. application Ser. No. 10/630,345 is also a continuation-in-part of U.S. application Ser. No. 10/079,794, entitled ACOUSTIC POSITION MEASUREMENT SYSTEM FOR WELL BORE FORMATION, filed Feb. 19, 2002, issued Jan. 24, 2006 as U.S. Pat. No. 6,988,566.

U.S. application Ser. No. 10/630,345 is also a continuation-in-part of U.S. application Ser. No. 10/004,316, entitled SLANT ENTRY WELL SYSTEM AND METHOD, filed Oct. 30, 2001, issued May 23, 2006 as U.S. Pat. No. 7,048,049.

U.S. application Ser. No. 10/630,345 is also a continuation-in-part of U.S. application Ser. No. 10/160,425, entitled WEDGE ACTIVATED UNDERREAMER, filed May 31, 2002, issued Nov. 8, 2005 as U.S. Pat. No. 6,962,216.

U.S. application Ser. No. 10/630,345 is also a continuation-in-part of U.S. application Ser. No. 10/194,366, entitled UNDULATING WELL BORE, filed Jul. 12, 2002, issued Mar. 23, 2004 as U.S. Pat. No. 6,708,764.

U.S. application Ser. No. 10/630,345 is also a continuation-in-part of U.S. application Ser. No. 10/227,057, entitled SYSTEM AND METHOD FOR SUBTERRANEAN ACCESS, now abandoned filed Aug. 22, 2002, published Feb. 26, 2004 as U.S. Publication Number US-2004-0035582-A1, which is a continuation-in-part of U.S. patent Ser. No. 09/774,996, entitled METHOD AND SYSTEM FOR ACCESSING SUBTERRANEAN ZONES FROM A LIMITED SURFACE AREA, filed Jan. 30, 2001, issued Dec. 16, 2003 as U.S. Pat. No. 6,662,870.

U.S. application Ser. No. 10/630,345 is also a continuation-in-part of U.S. application Ser. No. 10/323,192, entitled METHOD AND SYSTEM FOR CIRCULATING FLUID IN A WELL SYSTEM, filed Dec. 18, 2002, issued Apr. 11, 2006 as U.S. Pat. No. 7,025,154, which is a continuation-in-part of U.S. application Ser. No. 09/788,897, entitled MULTI-WELL STRUCTURE FOR ACCESSING SUBTERRANEAN DEPOSITS, filed Feb. 20, 2001, issued May 11, 2004 as U.S. Pat. No. 6,732,792, which is a divisional of U.S. application Ser. No. 09/444,029, entitled DRAINAGE PATTERN WITH INTERSECTING WELLS DRILLED FROM SURFACE, filed Nov. 19, 1999, issued Mar. 19, 2002 as U.S. Pat. No. 6,357,523, which is a continuation-in-part of U.S. application Ser. No. 09/197,687, entitled METHOD FOR PRODUCTION OF GAS FROM A COAL SEAM USING INTERSECTING WELL BORES, filed Nov. 20, 1998, issued Aug. 28, 2001 as U.S. Pat. No. 6,280,000.

U.S. application Ser. No. 10/630,345 is also a continuation-in-part of U.S. application Ser. No. 10/264,535, entitled METHOD AND SYSTEM FOR REMOVING FLUID FROM A SUBTERRANEAN ZONE USING AN ENLARGED CAVITY, filed Oct. 3, 2002, issued Jan. 24, 2006 as U.S. Pat. No. 6,988,548.

U.S. application Ser. No. 10/630,345 is also a continuation-in-part of U.S. application Ser. No. 10/224,082 entitled METHOD AND SYSTEM FOR CONTROLLING PRESSURE IN A DUAL WELL SYSTEM, filed Sep. 12, 2002, issued Jul. 11, 2006 as U.S. Pat. No. 7,073,595.

U.S. application Ser. No. 10/630,345 is also a continuation-in-part of U.S. application Ser. No. 09/769,098, entitled METHOD AND SYSTEM FOR ENHANCED ACCESS TO A SUBTERRANEAN ZONE, filed Jan. 24, 2001, issued Jul. 29, 2003 as U.S. Pat. No. 6,598,686, which is a continuation-in-part of U.S. application Ser. No. 09/696,338, entitled CAVITY WELL POSITIONING SYSTEM AND METHOD, filed Oct. 24, 2000, issued Sep. 24, 2002 as U.S. Pat. No. 6,454,000, which is a continuation-in-part of U.S. application Ser. No. 09/444,029, entitled DRAINAGE PATTERN WITH INTERSECTING WELLS DRILLED FROM SURFACE, filed Nov. 19, 1999, issued Mar. 19, 2002 as U.S. Pat. No. 6,357,523, which is a continuation-in-part of U.S. application Ser. No. 09/197,687, entitled METHOD FOR PRODUCTION OF GAS FROM A COAL SEAM USING INTERSECTING WELL BORES, filed Nov. 20, 1998, issued Aug. 28, 2001 as U.S. Pat. No. 6,280,000.

U.S. application Ser. No. 10/630,345 is also a continuation-in-part of U.S. application Ser. No. 10/003,917, entitled METHOD AND SYSTEM FOR SURFACE PRODUCTION OF GAS FROM A SUBTERRANEAN ZONE, filed Nov. 1, 2001, published Jul. 25, 2002 as U.S. Publication Number US 2002-0096336 A1, which is a continuation-in-part of U.S. application Ser. No. 09/444,029, entitled DRAINAGE PATTERN WITH INTERSECTING WELLS DRILLED FROM SURFACE, filed Nov. 19, 1999, issued Mar. 19, 2002 as U.S. Pat. No. 6,357,523, which is a continuation-in-part of U.S. application Ser. No. 09/197,687, entitled METHOD FOR PRODUCTION OF GAS FROM A COAL SEAM USING INTERSECTING WELL BORES, filed Nov. 20, 1998, issued Aug. 28, 2001 as U.S. Pat. No. 6,280,000. The disclosure of the prior applications are considered part of (and are incorporated by reference in) the disclosure of this application.

TECHNICAL FIELD OF THE INVENTION

The present invention relates generally to the recovery of subterranean deposits, and more particularly to a method and system for accessing subterranean deposits from the surface.

BACKGROUND OF THE INVENTION

Subterranean deposits of coal contain substantial quantities of entrained methane gas limited in production in use of methane gas from coal deposits has occurred for many years. Substantial obstacles, however, have frustrated more extensive development and use of methane gas deposits in coal seams. The foremost problem in producing methane gas from coal scams is that while coal scams may extend over large areas of up to several thousand acres, the coal seams are fairly shallow in depth, varying from a few inches to several meters. Thus, while the coal seams are often relatively near the surface, vertical wells drilled into the coal deposits for obtaining methane gas can only drain a fairly small radius around the coal deposits. Further, coal deposits are not amendable to pressure fracturing and other methods often used for increasing methane gas production from rock formations. As a result, once the gas easily drained from a vertical well bore in a coal seam is produced, further production is limited in volume. Additionally, coal seams are often associated with subterranean water, which must be drained from the coal seam in order to produce the methane.

Horizontal drilling patterns have been tried in order to extend the amount of coal seams exposed to a drill bore for gas extraction. Such horizontal drilling techniques, however, require the use of a radiused well bore which presents difficulties in removing the entrained water from the coal seam. The most efficient method for pumping water from a subterranean well, a sucker rod pump, does not work well in horizontal or radiused bores.

A further problem for surface production of gas from coal seams is the difficulty presented by over balanced drilling conditions caused by the porousness of the coal seam. During both vertical and horizontal surface drilling operations, drilling fluid is used to remove cuttings from the well bore to the surface. The drilling fluid exerts a hydrostatic pressure on the formation which, if it exceeds the hydrostatic pressure of the formation, can result in a loss of drilling fluid into the formation. This results in entrainment of drilling finds in the formation, which tends to plug the pores, cracks, and fractures that are needed to produce the gas.

As a result of these difficulties in surface production of methane gas from coal deposits, the methane gas which must be removed from a coal seam prior to mining, has been removed from coal seams through the use of subterranean methods. While the use of subterranean methods allows water to be easily removed from a coal seam and eliminates over balanced drilling conditions, they can only access a limited amount of the coal seams exposed by current mining operations. Where longwall mining is practiced, for example, underground drilling rigs are used to drill horizontal holes from a panel currently being mined into an adjacent panel that will later be mined. The limitations of underground rigs limits the reach of such horizontal holes and thus the area that can be effectively drained. In addition, the degasification of a next panel during mining of a current panel limits the time for degasification. As a result, many horizontal bores must be drilled to remove the gas in a limited period of time. Furthermore, in conditions of high gas content or migration of gas through a coal seam, mining may need to be halted or delayed until a next panel can be adequately degasified. These production delays add to the expense associated with degasifying a coal seam.

SUMMARY OF THE INVENTION

The present invention provides an improved method and system for accessing subterranean deposits from the surface that substantially eliminates or reduces the disadvantages and problems associated with previous systems and methods. In particular, the present invention provides an articulated well with a drainage pattern that intersects a horizontal cavity well. The drainage patterns provide access to a large subterranean area from the surface while the vertical cavity well allows entrained water, hydrocarbons, and other deposits to be efficiently removed and/or produced.

In accordance with one embodiment of the present invention, a method for accessing a subterranean zone from the surface includes drilling a substantially vertical well bore from the surface to the subterranean zone. An articulated well bore is drilled from the surface to the subterranean zone. The articulated well bore is horizontally offset from the substantially vertical well bore at the surface and intersects the substantially vertical well bore at a junction proximate to the subterranean zone. A substantially horizontal drainage pattern is drilled through the articulated well bore from the junction into the subterranean zone.

In accordance with another aspect of the present invention, the substantially horizontal drainage pattern may comprise a pinnate pattern including a substantially horizontal diagonal well bore extending from the substantially vertical well bore that defines a first end of an area covered by the drainage pattern to a distant end of the area. A first of substantially horizontal lateral well bores extend in space relation to each other from the diagonal well bore to the periphery of the area on a first side of the diagonal well bore. A second set of substantially horizontal lateral well bores extend in space relation to each other from the diagonal well bore to the periphery of the area on a second, opposite side of the diagonal.

In accordance with still another aspect of the present invention, a method for preparing a subterranean zone for mining uses the substantially vertical and articulated well bores and the drainage pattern. Water is drained from the subterranean zone through the drainage pattern to the junction of the substantially vertical well bore. Water is pumped from the junction to the surface through the substantially vertical well bore. Gas is produced from the subterranean zone through at least one of the substantially vertical and articulated well bores. After degasification has been completed, the subterranean zone may be further prepared by pumping water and other additives into the zone through the drainage pattern.

In accordance with yet another aspect of the present invention, a pump positioning device is provided to accurately position a downhole pump in a cavity of a well bore.

Technical advantages of the present invention include providing an improved method and system for accessing subterranean deposits from the surface. In particular, a horizontal drainage pattern is drilled in a target zone from an articulated surface well to provide access to the zone from the surface. The drainage pattern intersected by a vertical cavity well from which entrained water, hydrocarbons, and other fluids drained from the zone can be efficiently removed and/or produced by a rod pumping unit. As a result, gas, oil, and other fluids can be efficiently produced at the surface from a low pressure or low porosity formation.

Another technical advantage of the present invention includes providing an improved method and system for drilling into low-pressure reservoirs. In particular, a downhole pump or gas lift is used to lighten hydrostatic pressure exerted by drilling fluids used to remove cuttings during drilling operations. As a result, reservoirs may be drilled at ultra-low pressures without loss of drilling fluids into the formation and plugging of the formation.

Yet another technical advantage of the present invention includes providing an improved horizontal drainage pattern for accessing a subterranean zone. In particular, a pinnate structure with a main diagonal and opposed laterals is used to maximize access to a subterranean zone from a single vertical well bore. Length of the laterals is maximized proximate to the vertical well bore and decreased toward the end of the main diagonal to provide uniform access to a quadrilateral or other grid area. This allows the drainage pattern to be aligned with longwall panels and other subsurface structures for degasification of a mine coal seam or other deposit.

Still another technical advantage of the present invention includes providing an improved method and system for preparing a coal seam or other subterranean deposit for mining. In particular, surface wells are used to degasify a coal seam ahead of mining operations. This reduces underground equipment and activities and increases the time provided to degasify the seam which minimizes shutdowns due to high gas content. In addition, water and additives may be pumped into the degasified coal seam prior to mining operations to minimize dust and other hazardous conditions, to improve efficiency of the mining process, and to improve the quality of the coal product.

Still another technical advantage of the present invention includes providing an improved method and system for producing methane gas from a mined coal seam. In particular, well bores used to initially degasify a coal scam prior to mining operations may be reused to collect gob gas from the seam after mining operation. As a result, costs associated with the collection of gob gas are minimized to facilitate or make feasible the collection of gob gas from previously mined seams.

Still another technical advantage of the present invention includes providing a positioning device for automatically positioning down-hole pumps and other equipment in a cavity. In particular, a rotatable cavity positioning device is configured to retract for transport in a well bore and to extend within a down-hole cavity to optimally position the equipment within the cavity. This allows down-hole equipment to be easily positioned and secured within the cavity.

Other technical advantages of the present invention will be readily apparent to one skilled in the art from the following figures, description, and claims.

BRIEF DESCRIPTION OF THE DRAWINGS

For a more complete understanding of the present invention and its advantages, reference is now made to the following description taken in conjunction with the accompanying drawings, wherein like numerals represent like parts, in which.

DETAILED DESCRIPTION OF THE INVENTION

Figure 1:
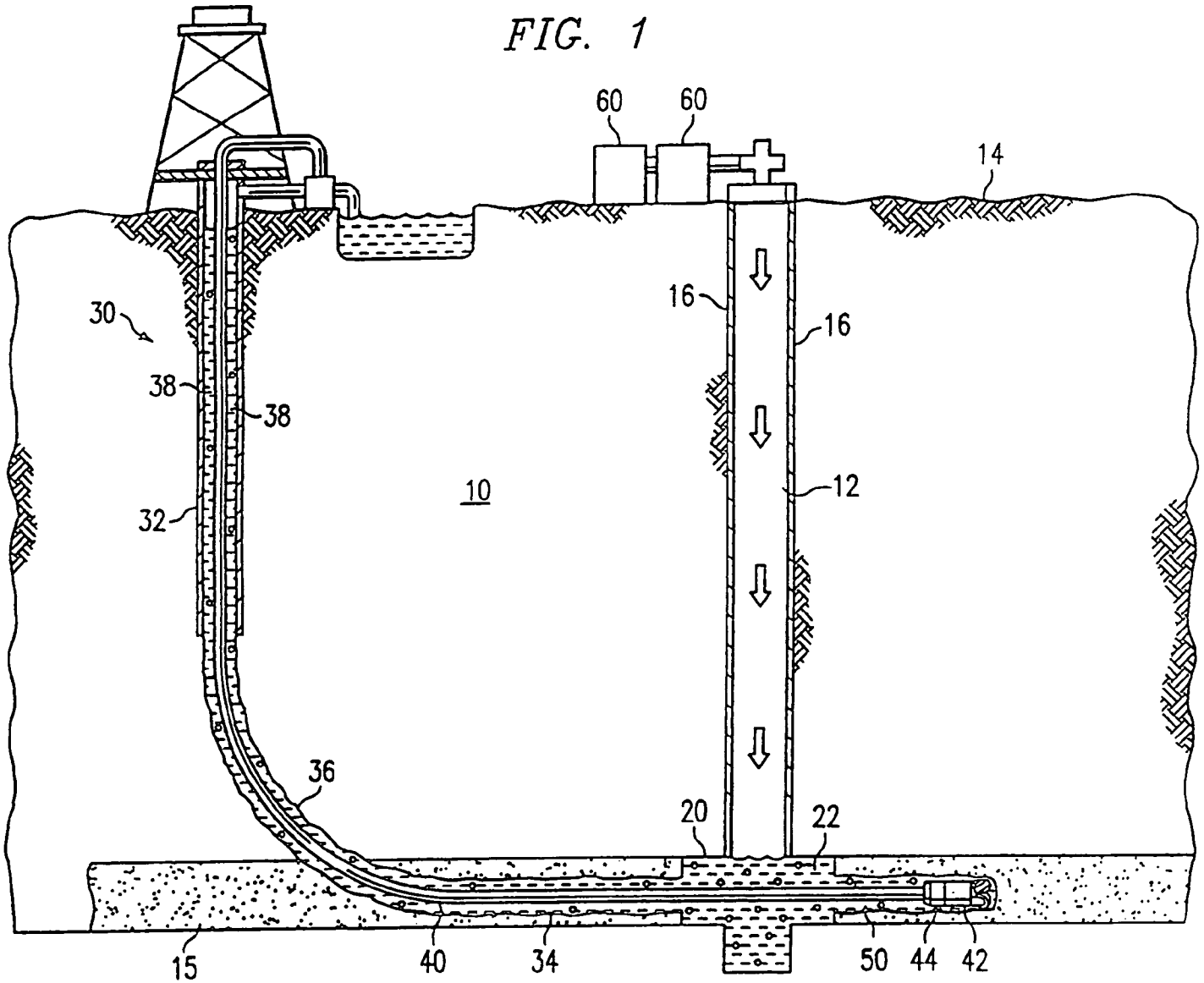
FIG. 1 is a cross-sectional diagram illustrating formation of a horizontal drainage pattern in a subterranean zone through an articulated surface well intersecting a vertical cavity well in accordance with one embodiment of the present invention.

FIG. 1 illustrates a cavity and articulated well combination for accessing a subterranean zone from the surface in accordance with one embodiment of the present invention. In this embodiment, the subterranean zone is a coal seam. It will be understood that other low pressure, ultra-low pressure, and low porosity subterranean zones can be similarly accessed using the dual well system of the present invention to remove and/or produce water, hydrocarbons and other fluids in the zone and to treat minerals in the zone prior to mining operations.

Referring to FIG. 1, a substantially vertical well bore 12 extends from the surface 14 to a target coal seam 15. The substantially vertical well bore 12 intersects, penetrates and continues below the coal seam 15. The substantially vertical well bore is lined with a suitable well casing 16 that terminates at or above the level of the coal seam 15.

The substantially vertical well bore 12 is logged either during or after drilling in order to locate the exact vertical depth of the coal seam 15. As a result, the coal seam is not missed in subsequent drilling operations and techniques used to locate the seam 15 while drilling need not be employed. An enlarged diameter cavity 20 is formed in the substantially vertical well bore 12 at the level of the coal seam 15. As described in more detail below, the enlarged diameter cavity 20 provides a junction for intersection of the substantially vertical well bore by articulated well bore used to form a substantially horizontal drainage pattern in the coal seam 15. The enlarged diameter cavity 20 also provides a collection point for fluids drained from the coal seam 15 during production operations.

In one embodiment, the enlarged diameter cavity 20 has a radius of approximately eight feet and a vertical dimension which equals or exceeds the vertical dimension of the coal seam 15. The enlarged diameter cavity 20 is formed using suitable under-reaming techniques and equipment. A vertical portion of the substantially vertical well bore 12 continues below the enlarged diameter cavity 20 to form a sump 22 for the cavity 20.

An articulated well bore 30 extends from the surface 14 to the enlarged diameter cavity 20 of the substantially vertical well bore 12. The articulated well bore 30 includes a substantially vertical portion 32, a substantially horizontal portion 34, and a curved or radiused portion 36 interconnecting the vertical and horizontal portions 32 and 34. The horizontal portion 34 lies substantially in the horizontal plane of the coal seam 15 and intersects the large diameter cavity 20 of the substantially vertical well bore 12.

The articulated well bore 30 is offset a sufficient distance from the substantially vertical well bore 12 at the surface 14 to permit the large radius curved section 36 and any desired horizontal section 34 to be drilled before intersecting the enlarged diameter cavity 20. To provide the curved portion 36 with a radius of 100-150 feet, the articulated well bore 30 is offset a distance of about 300 feet from the substantially vertical well bore 12. This spacing minimizes the angle of the curved portion 36 to reduce friction in the bore 30 during drilling operations. As a result, reach of the articulated drill string drilled through the articulated well bore 30 is maximized.

The articulated well bore 30 is drilled using articulated drill string 40 that includes a suitable down-hole motor and bit 42. A measurement while drilling (MWD) device 44 is included in the articulated drill string 40 for controlling the orientation and direction of the well bore drilled by the motor and bit 42. The substantially vertical portion 32 of the articulated well bore 30 is lined with a suitable casing 38.

After the enlarged diameter cavity 20 has been successfully intersected by the articulated well bore 30, drilling is continued through the cavity 20 using the articulated drill string 40 and appropriate horizontal drilling apparatus to provide a substantially horizontal drainage pattern 50 in the coal seam 15. The substantially horizontal drainage pattern 50 and other such well bores include sloped, undulating, or other inclinations of the coal seam 15 or other subterranean zone. During this operation, gamma ray logging tools and conventional measurement while drilling devices may be employed to control and direct the orientation of the drill bit to retain the drainage pattern 50 within the confines of the coal seam 15 and to provide substantially uniform coverage of a desired area within the coal seam 15. Further information regarding the drainage pattern is described in more detail below in connection with FIGS. 4-7.

During the process of drilling the drainage pattern 50, drilling fluid or "mud" is pumped down the articulated drill string 40 and circulated out of the drill string 40 in the vicinity of the bit 42, where it is used to scour the formation and to remove formation cuttings. The cuttings are then entrained in the drilling fluid which circulates up through the annulus between the drill string 40 and the well bore walls until it reaches the surface 14, where the cuttings are removed from the drilling fluid and the fluid is then recirculated. This conventional drilling operation produces a standard column of drilling fluid having a vertical height equal to the depth of the well bore 30 and produces a hydrostatic pressure on the well bore corresponding to the well bore depth. Because coal seams tend to be porous and fractured, they may be unable to sustain such hydrostatic pressure, even if formation water is also present in the coal seam 15. Accordingly, if the full hydrostatic pressure is allowed to act on the coal seam 15, the result may be loss of drilling fluid and entrained cuttings into the formation. Such a circumstance is referred to as an "over balanced" drilling operation in which the hydrostatic fluid pressure in the well bore exceeds the ability of the formation to withstand the pressure. Loss of drilling fluids in cuttings into the formation not only is expensive in terms of the lost drilling fluids, which must be made up, but it tends to plug the pores in the coal seam 15, which are needed to drain the coal seam of gas and water.

To prevent over balance drilling conditions during formation of the drainage pattern 50, air compressors 60 are provided to circulate compressed air down the substantially vertical well bore 12 and back up through the articulated well bore 30. The circulated air will admix with the drilling fluids in the annulus around the articulated drill string 40 and create bubbles throughout the column of drilling fluid. This has the effective of lightening the hydrostatic pressure of the drilling fluid and reducing the down-hole pressure sufficiently that drilling conditions do not become over balanced. Aeration of the drilling fluid reduces down-hole pressure to approximately 150-200 pounds per square inch (psi). Accordingly, low pressure coal seams and other subterranean zones can be drilling without substantial loss of drilling fluid and contamination of the zone by the drilling fluid.

Foam, which may be compressed air mixed with water, may also be circulated down through the articulated drill string 40 along with the drilling mud in order to aerate the drilling fluid in the annulus as the articulated well bore 30 is being drilled and, if desired, as the drainage pattern 50 is being drilled. Drilling of the drainage pattern 50 with the use of an air hammer bit or an air-powered down-hole motor will also supply compressed air or foam to the drilling fluid. In this case, the compressed air or foam which is used to power the bit or down-hole motor exits the vicinity of the drill bit 42. However, the larger volume of air which can be circulated down the substantially vertical well bore 12, permits greater aeration of the drilling fluid than generally is possible by air supplied through the articulated drill string 40.

Figure 2:
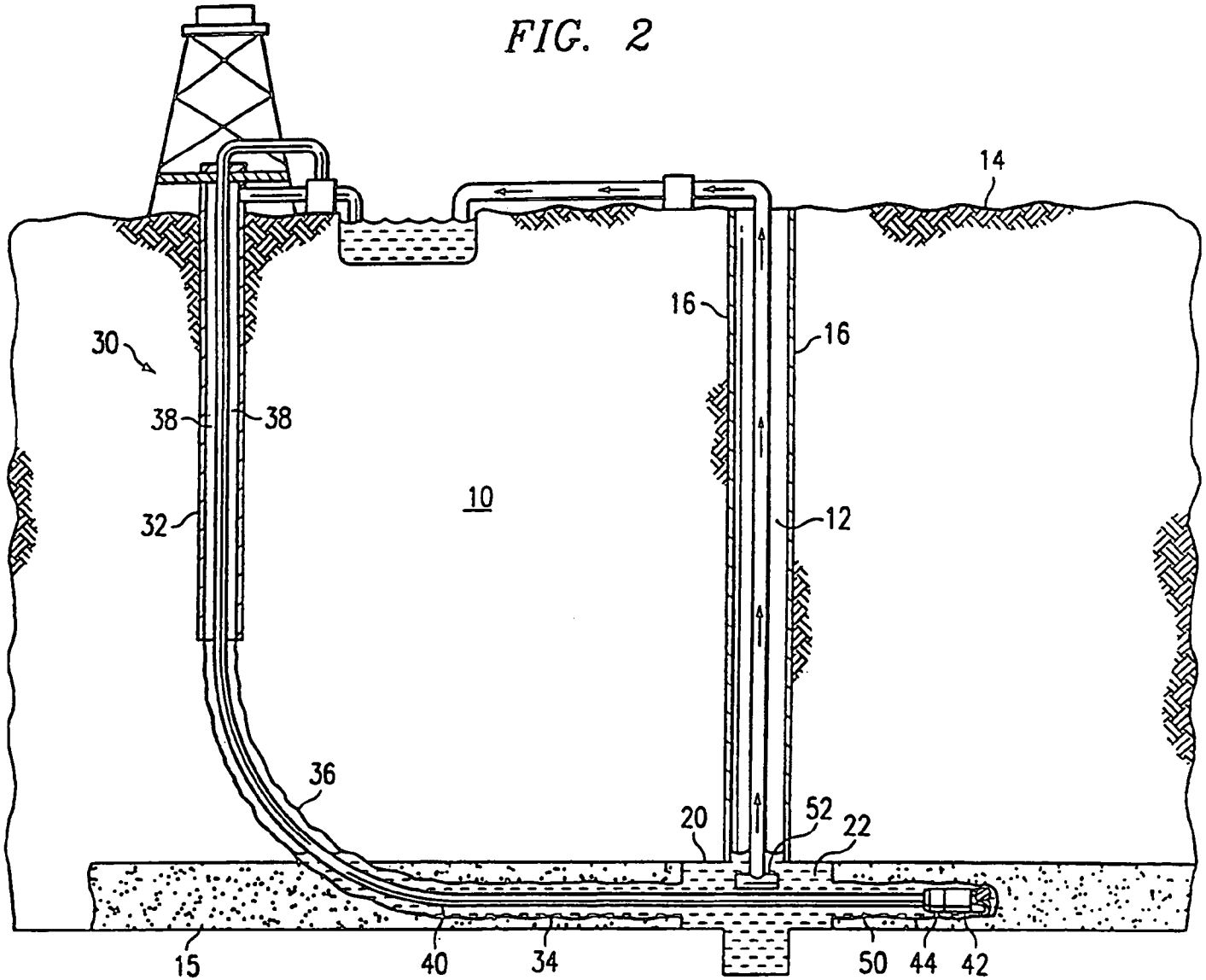
FIG. 2 is a cross-sectional diagram illustrating formation of the horizontal drainage pattern in the subterranean zone through the articulated surface well intersecting the vertical cavity well in accordance with another embodiment of the present invention.

FIG. 2 illustrates method and system for drilling the drainage pattern 50 in the coal seam 15 in accordance with another embodiment of the present invention. In this embodiment, the substantially vertical well bore 12, enlarged diameter cavity 20 and articulated well bore 32 are positioned and formed as previously described in connection with the FIG. 1.

Referring to FIG. 2, after intersection of the enlarged diameter cavity 20 by the articulated well bore 30 a pump 52 is installed in the enlarged diameter cavity 20 to pump drilling fluid and cuttings to the surface 14 through the substantially vertical well bore 12. This eliminates the friction of air and fluid returning up the articulated well bore 30 and reduces down-hole pressure to nearly zero. Accordingly, coal seams and other subterranean zones having ultra low pressures below 150 psi can be accessed from the surface. Additionally, the risk of combining air and methane in the well is eliminated.

Figure 3:
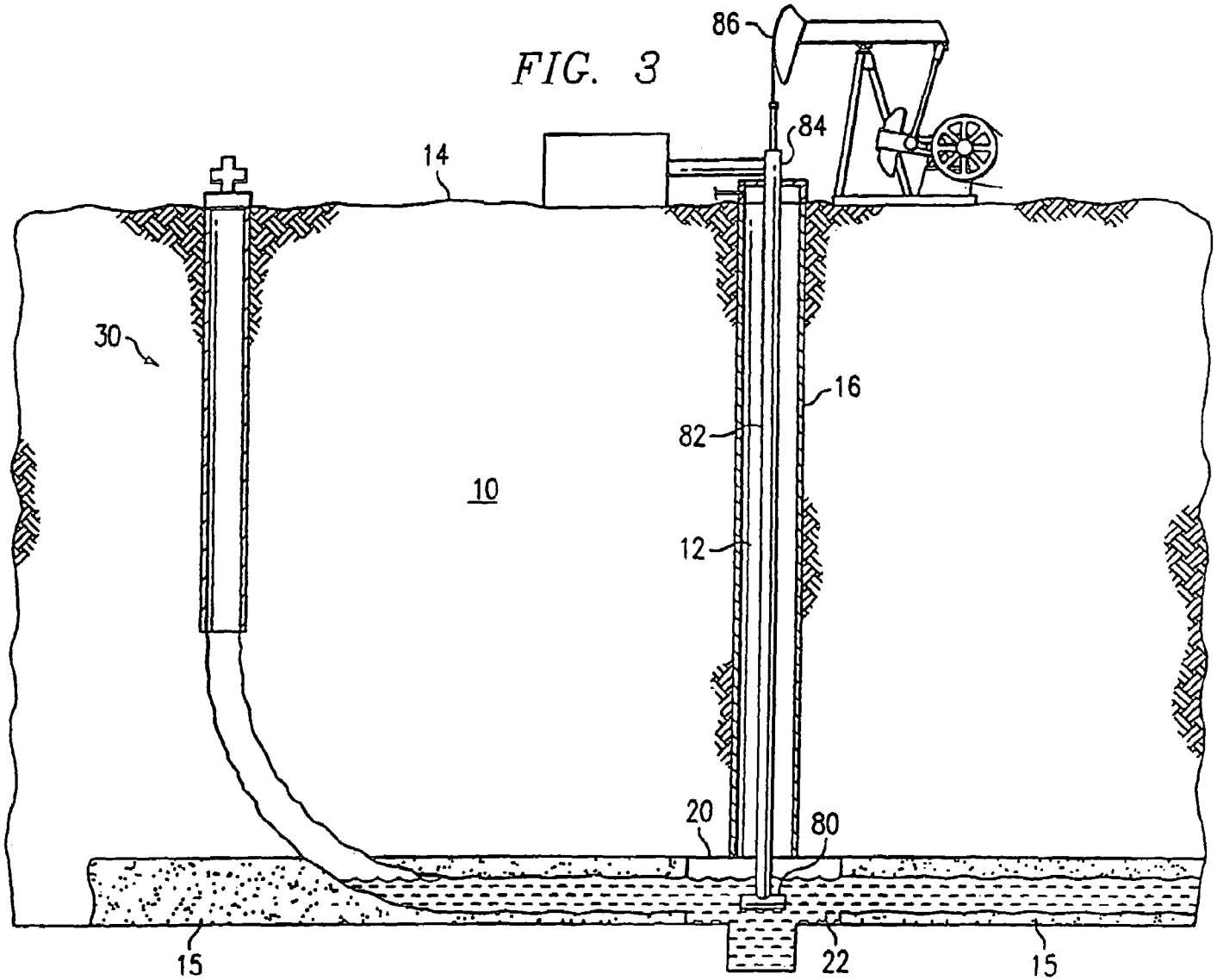
FIG. 3 is a cross-sectional diagram illustrating production of fluids from a horizontal draining pattern in a subterranean zone through a vertical well bore in accordance with one embodiment of the present invention.

FIG. 3 illustrates production of fluids from the horizontal drainage pattern 50 in the coal seam 15 in accordance with one embodiment of the present invention. In this embodiment, after the substantially vertical and articulated well bores 12 and 30 as well as desired drainage pattern 50 have been drilled, the articulated drill string 40 is removed from the articulated well bore 30 and the articulated well bore is capped. For multiple pinnate structure described below, the articulated well 30 may be plugged in the substantially horizontal portion 34. Otherwise, the articulated well 30 may be left unplugged.

Referring to FIG. 3, a down hole pump 80 is disposed in the substantially vertical well bore 12 in the enlarged diameter cavity 22. The enlarged cavity 20 provides a reservoir for accumulated fluids allowing intermittent pumping without adverse effects of a hydrostatic head caused by accumulated fluids in the well bore.

The down hole pump 140 is connected to the surface 14 via a tubing string 82 and may be powered by sucker rods 84 extending down through the well bore 12 of the tubing. The sucker rods 84 are reciprocated by a suitable surface mounted apparatus, such as a powered walking beam 86 to operate the down hole pump 80. The down hole pump 80 is used to remove water and entrained coal fines from the coal seam 15 via the drainage pattern 50. Once the water is removed to the surface, it may be treated for separation of methane which may be dissolved in the water and for removal of entrained fines. After sufficient water has been removed from the coal seam 15, pure coal seam gas may be allowed to flow to the surface 14 through the annulus of the substantially vertical well bore 12 around the tubing string 82 and removed via piping attached to a wellhead apparatus. At the surface, the methane is treated, compressed and pumped through a pipeline for use as a fuel in a conventional manner. The down hole pump 80 may be operated continuously or as needed to remove water drained from the coal seam 15 into the enlarged diameter cavity 22.

FIGS. 4-7 illustrate substantially horizontal drainage patterns 50 for accessing the coal seam 15 or other subterranean zone in accordance with one embodiment of the present invention. In this embodiment, the drainage patterns comprise pinnate patterns that have a central diagonal with generally symmetrically arranged and appropriately spaced laterals extending from each side of the diagonal. The pinnate pattern approximates the pattern of veins in a leaf or the design of a feather in that it has similar, substantially parallel, auxiliary drainage bores arranged in substantially equal and parallel spacing or opposite sides of an axis. The pinnate drainage pattern with its central bore and generally symmetrically arranged and appropriately spaced auxiliary drainage bores on each side provides a uniform pattern for draining fluids from a coal seam or other subterranean formation. As described in more detail below, the pinnate pattern provides substantially uniform coverage of a square, other quadrilateral, or grid area and may be aligned with longwall mining panels for preparing the coal seam 15 for mining operations. It will be understood that other suitable drainage patterns may be used in accordance with the present invention.

The pinnate and other suitable drainage patterns drilled from the surface provide surface access to subterranean formations. The drainage pattern may be used to uniformly remove and/or insert fluids or otherwise manipulate a subterranean deposit. In non coal applications, the drainage pattern may be used initiating in-situ burns, "huff-puff" steam operations for heavy crude oil, and the removal of hydrocarbons from low porosity reservoirs.

Figure 4:
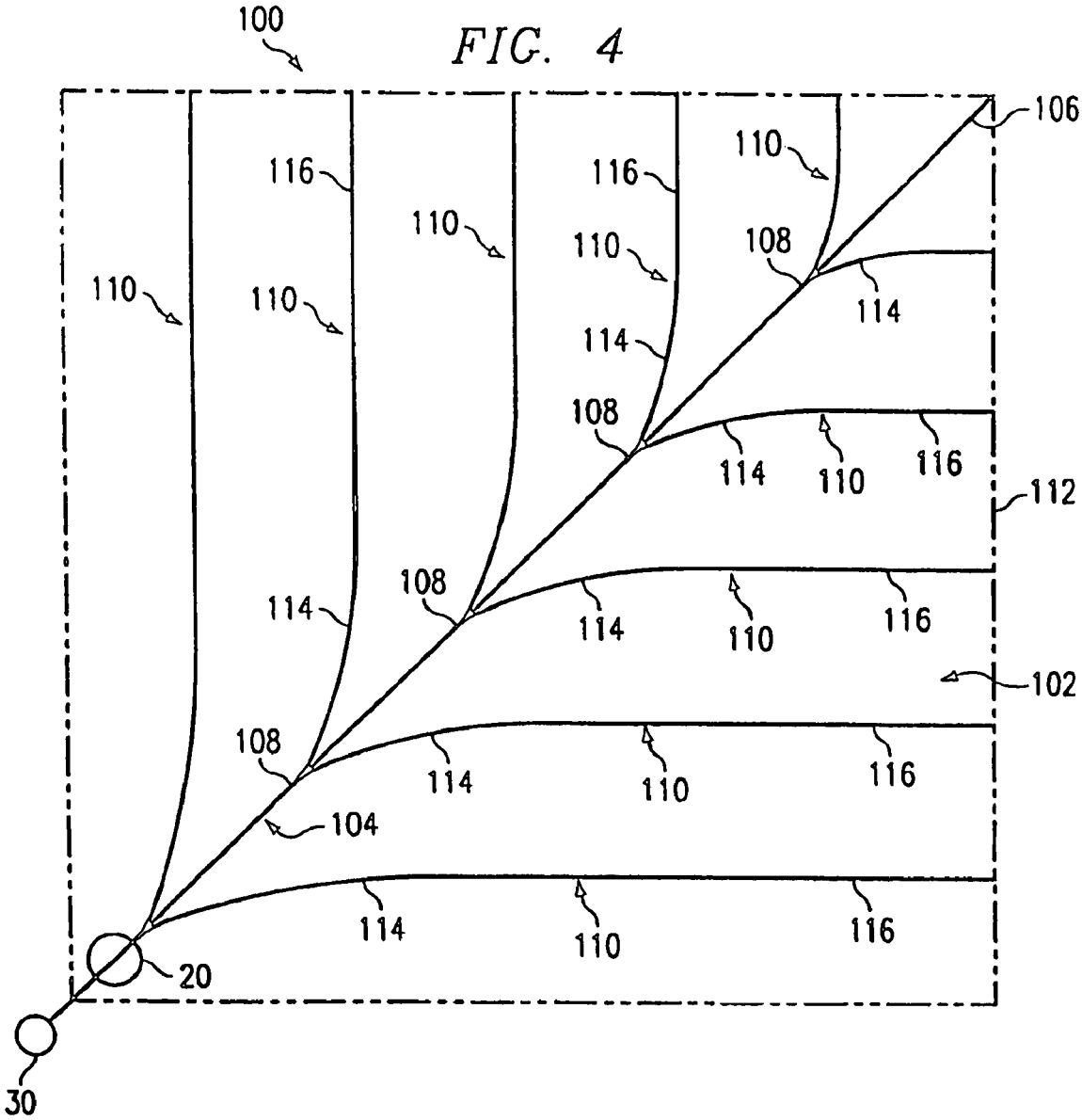
FIG. 4 is a top plan diagram illustrating a pinnate drainage pattern for accessing deposits in a subterranean zone in accordance with one embodiment of the present invention.

FIG. 4 illustrates a pinnate drainage pattern 100 in accordance with one embodiment of the present invention. In this embodiment, the pinnate drainage pattern 100 provides access to a substantially square area 102 of a subterranean zone. A number of the pinnate patterns 60 may be used together to provide uniform access to a large subterranean region.

Referring to FIG. 4, the enlarged diameter cavity 20 defines a first corner of the area 102. The pinnate pattern 100 includes a substantially horizontal main well bore 104 extending diagonally across the area 102 to a distant corner 106 of the area 102. Preferably, the substantially vertical and articulated well bores 12 and 30 are positioned over the area 102 such that the diagonal bore 104 is drilled up the slope of the coal seam 15. This will facilitate collection of water, gas from the area 102. The diagonal bore 104 is drilled using the articulated drill string 40 and extends from the enlarged cavity 20 in alignment with the articulated well bore 30.

A plurality of lateral well bores 110 extend from the opposites sides of diagonal bore 104 to a periphery 112 of the area 102. The lateral bores 122 may mirror each other on opposite sides of the diagonal bore 104 or may be offset from each other along the diagonal bore 104. Each of the lateral bores 110 includes a radius curving portion 114 coming off of the diagonal bore 104 and an elongated portion 116 formed after the curved portion 114 has reached a desired orientation. For uniform coverage of the square area 102, pairs of lateral bores 110 are substantially evenly spaced on each side of the diagonal bore 104 and extend from the diagonal 64 at an angle of approximately 45 degrees. The lateral bores 110 shorten in length based on progression away from the enlarged diameter cavity 20 in order to facilitate drilling of the lateral bores 110.

The pinnate drainage pattern 100 using a single diagonal bore 104 and five pairs of lateral bores 110 may drain a coal seam area of approximately 150 acres in size. Where a smaller area is to be drained, or where the coal seam has a different shape, such as a long, narrow shape or due to surface or subterranean topography, alternate pinnate drainage patterns may be employed by varying the angle of the lateral bores 110 to the diagonal bore 104 and the orientation of the lateral bores 110. Alternatively, lateral bores 120 can be drilled from only one side of the diagonal bore 104 to form a one-half pinnate pattern.

The diagonal bore 104 and the lateral bores 110 are formed by drilling through the enlarged diameter cavity 20 using the articulated drill string 40 and appropriate horizontal drilling apparatus. During this operation, gamma ray logging tools and conventional measurement while drilling technologies may be employed to control the direction and orientation of the drill bit so as to retain the drainage pattern within the confines of the coal seam 15 and to maintain proper spacing and orientation of the diagonal and lateral bores 104 and 110.

In a particular embodiment, the diagonal bore 104 is drilled with an incline at each of a plurality of lateral kick-off points 108. After the diagonal 104 is complete, the articulated drill string 40 is backed up to each successive lateral point 108 from which a lateral bore 110 is drilled on each side of the diagonal 104. It will be understood that the pinnate drainage pattern 100 may be otherwise suitably formed in accordance with the present invention.

Figure 5:
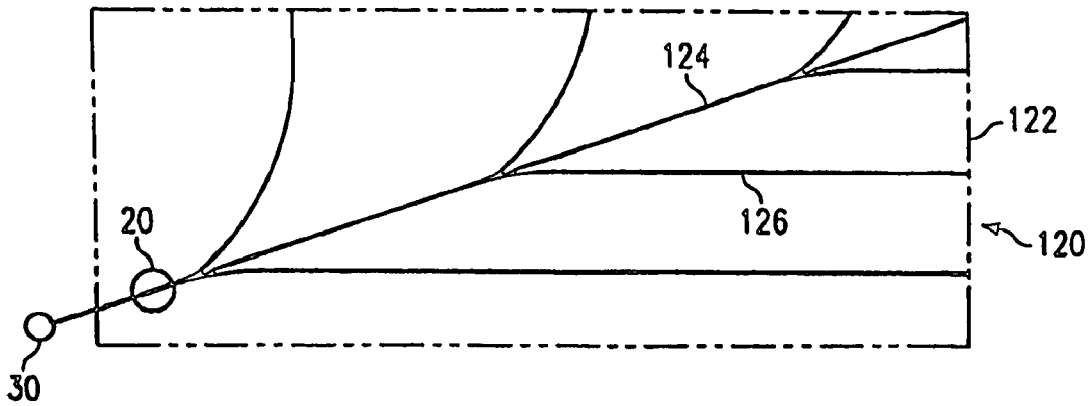
FIG. 5 is a top plan diagram illustrating a pinnate drainage pattern for accessing deposits in a subterranean zone in accordance with another embodiment of the present invention.

FIG. 5 illustrates a pinnate drainage pattern 120 in accordance with another embodiment of the present invention. In this embodiment, the pinnate drainage pattern 120 drains a substantially rectangular area 122 of the coal seam 15. The pinnate drainage pattern 120 includes a main diagonal bore 124 and a plurality of lateral bores 126 that are formed as described in connection with diagonal and lateral bores 104 and 110 of FIG. 4. For the substantially rectangular area 122, however, the lateral bores 126 on a first side of the diagonal 124 include a shallow angle while the lateral bores 126 on the opposite side of the diagonal 124 include a steeper angle to together provide uniform coverage of the area 12.

Figure 6:
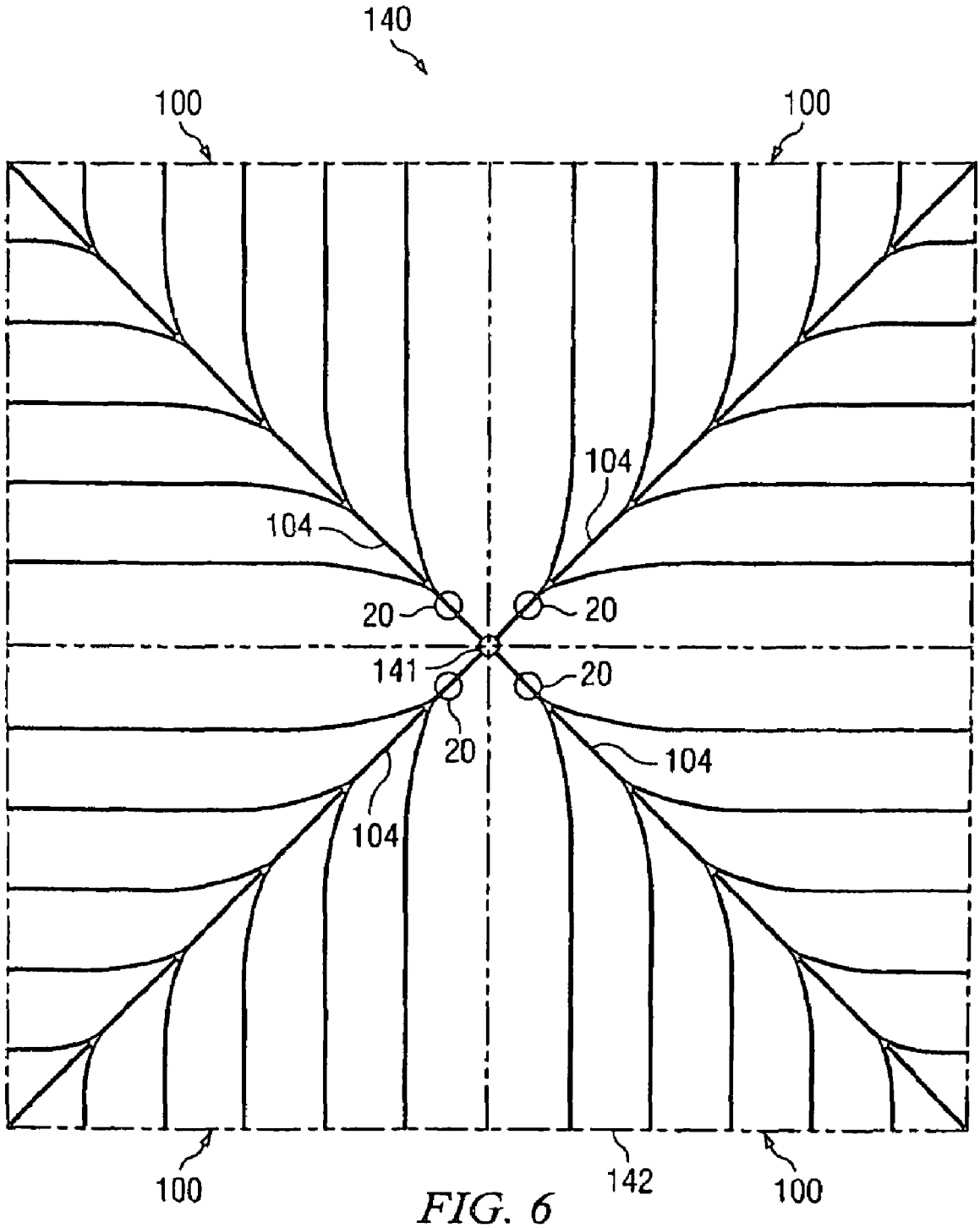
FIG. 6 is a top plan diagram illustrating a quadrilateral pinnate drainage pattern for accessing deposits in a subterranean zone in accordance with still another embodiment of the present invention.

FIG. 6 illustrates a quadrilateral pinnate drainage pattern 140 in accordance with another embodiment of the present invention. The quadrilateral drainage pattern 140 includes four discrete pinnate drainage patterns 100 each draining a quadrant of a region 142 covered by the pinnate drainage pattern 140.

Each of the pinnate drainage patterns 100 includes a diagonal well bore 104 and a plurality of lateral well bores 110 extending from the diagonal well bore 104. In the quadrilateral embodiment, each of the diagonal and lateral bores 104 and 110 are drilled from a common articulated well bore 141. This allows tighter spacing of the surface production equipment, wider coverage of a drainage pattern and reduces drilling equipment and operations.

Figure 7:
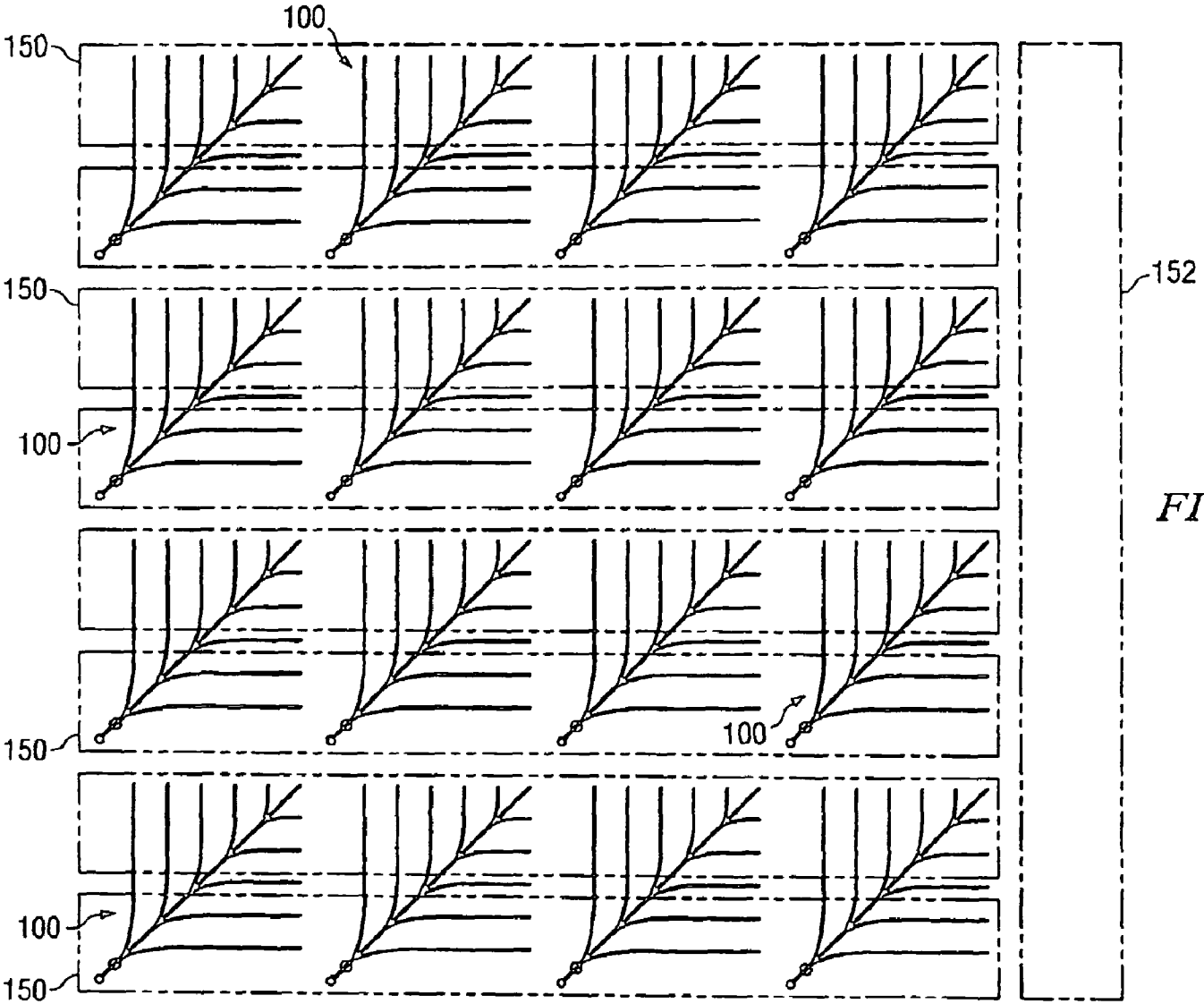
FIG. 7 is a top plan diagram illustrating the alignment of pinnate drainage patterns within panels of a coal seam for degasifying and preparing the coal seam for mining operations in accordance with one embodiment of the present invention.

FIG. 7 illustrates the alignment of pinnate drainage patterns 100 with subterranean structures of a coal seam for degasifying and preparing the coal seam for mining operations in accordance with one embodiment of the present invention. In this embodiment, the coal seam 15 is mined using a longwall process. It will be understood that the present invention can be used to degasify coal seams for other types of mining operations.

Referring to FIG. 7, coal panels 150 extend longitudinally from a longwall 152. In accordance with longwall mining practices, each panel 150 is subsequently mined from a distant end toward the longwall 152 and the mine roof allowed to cave and fracture into the opening behind the mining process. Prior to mining of the panels 150, the pinnate drainage patterns 100 are drilled into the panels 150 from the surface to degasify the panels 150 well ahead of mining operations. Each of the pinnate drainage patterns 100 is aligned with the longwall 152 and panel 150 grid and covers portions of one or more panels 150. In this way, a region of a mine can be degasified from the surface based on subterranean structures and constraints.

Figure 8:
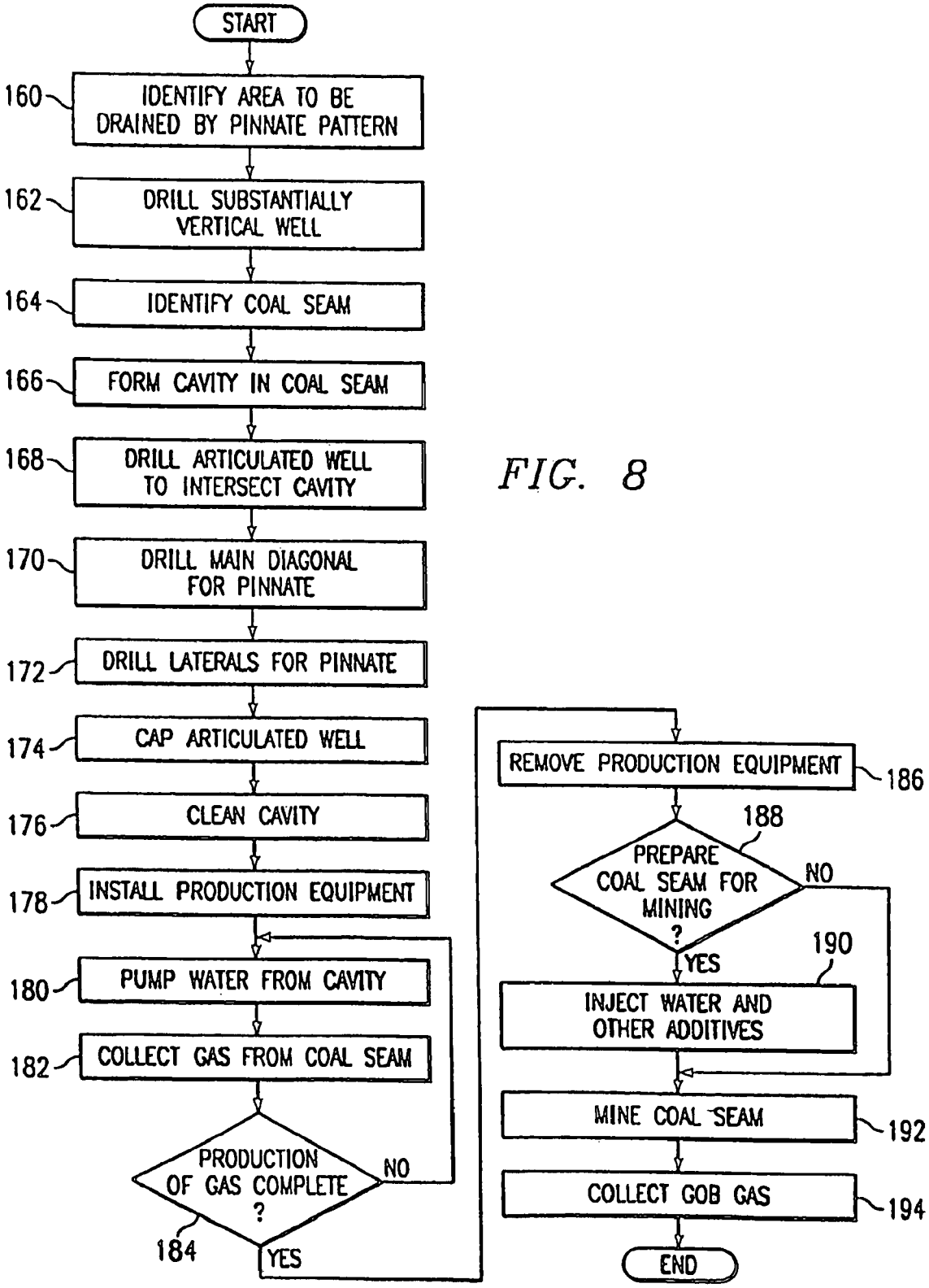
FIG. 8 is a flow diagram illustrating a method for preparing a coal seam for mining operations in accordance with one embodiment of the present invention.

FIG. 8 is a flow diagram illustrating a method for preparing the coal seam 15 for mining operations in accordance with one embodiment of the present invention. In this embodiment, the method begins at step 160 in which areas to be drained and drainage patterns 50 for the areas are identified. Preferably, the areas are aligned with the grid of a mining plan for the region. Pinnate structures 100, 120 and 140 may be used to provide optimized coverage for the region. It will be understood that other suitable patterns may be used to degasify the coal seam 15.

Proceeding to step 162, the substantially vertical well 12 is drilled from the surface 14 through the coal seam 15. Next, at step 164, down hole logging equipment is utilized to exactly identify the location of the coal seam in the substantially well bore 12. At step 164, the enlarged diameter cavity 22 is formed in the substantially vertical well bore 12 at the location of the coal seam 15. As previously discussed, the enlarged diameter cavity 20 may be formed by under reaming and other conventional techniques.

Next, at step 166, the articulated well bore 30 is drilled to intersect the enlarged diameter cavity 22. At step 168, the main diagonal bore 104 for the pinnate drainage pattern 100 is drilled through the articulated well bore 30 into the coal seam 15. After formation of the main diagonal 104, lateral bores 110 for the pinnate drainage pattern 100 are drilled at step 170. As previously described, lateral kick-off points may be formed in the diagonal bore 104 during its formation to facilitate drilling of the lateral bores 110.

At step 172, the articulated well bore 30 is capped. Next, at step 174, the enlarged diagonal cavity 22 is cleaned in preparation for installation of downhole production equipment. The enlarged diameter cavity 22 may be cleaned by pumping compressed air down the substantially vertical well bore 12 or other suitable techniques. At step 176, production equipment is installed in the substantially vertical well bore 12. The production equipment includes a sucker rod pump extending down into the cavity 22 for removing water from the coal seam 15. The removal of water will drop the pressure of the coal seam and allow methane gas to diffuse and be produced up the annulus of the substantially vertical well bore 12.

Proceeding to step 178, water that drains from the drainage pattern 100 into the cavity 22 is pumped to the surface with the rod pumping unit. Water may be continuously or intermittently be pumped as needed to remove it from the cavity 22. At step 180, methane gas diffused from the coal seam 15 is continuously collected at the surface 14. Next, at decisional step 182 it is determined whether the production of gas from the coal seam 15 is complete. In one embodiment, the production of gas may be complete after the cost of the collecting the gas exceeds the revenue generated by the well. In another embodiment, gas may continue to be produced from the well until a remaining level of gas in the coal seam 15 is below required levels for mining operations. If production of the gas is not complete, the No branch of decisional step 182 returns to steps 178 and 180 in which water and gas continue to be removed from the coal seam 15. Upon completion of production, the Yes branch of decisional step 182 leads to step 184 in which the production equipment is removed.

Next, at decisional step 186, it is determined whether the coal seam 15 is to be further prepared for mining operations. If the coal seam 15 is to be further prepared for mining operations, the Yes branch of decisional step 186 leads to step 188 in which water and other additives may be injected back into the coal seam 15 to rehydrate the coal seam in order to minimize dust, to improve the efficiency of mining, and to improve the mined product.

Step 188 and the No branch of decisional step 186 lead to step 190 in which the coal seam 15 is mined. The removal of the coal from the seam causes the mined roof to cave and fracture into the opening behind the mining process. The collapsed roof creates gob gas which may be collected at step 192 through the substantially vertical well bore 12. Accordingly, additional drilling operations are not required to recover gob gas from a mined coal seam. Step 192 leads to the end of the process by which a coal seam is efficiently degasified from the surface. The method provides a symbiotic relationship with the mine to remove unwanted gas prior to mining and to rehydrate the coal prior to the mining process.

A well cavity pump comprises a well bore portion and a cavity positioning device. The well bore portion comprises an inlet for drawing and transferring well fluid contained within cavity 20 to a surface of vertical well bore 12.

In this embodiment, the cavity positioning device is rotatably coupled to the well bore portion to provide rotational movement of the cavity positioning device relative to the well bore portion. For example, a pin, shaft, or other suitable method or device (not explicitly shown) may be used to rotatably couple the cavity position device to the well bore portion to provide pivotal movement of the cavity positioning device about an axis relative to the well bore portion. Thus, the cavity positioning device may be coupled to the well bore portion between two ends of the cavity positioning device such that both ends may be rotatably manipulated relative to the well bore portion.

The cavity positioning device also comprises a counter balance portion to control a position of the ends relative to the well bore portion in a generally unsupported condition. For example, the cavity positioning device is generally cantilevered about the axis relative to the well bore portion. The counter balance portion is disposed along the cavity positioning device between the axis and the end such that a weight or mass of the counter balance portion counter balances the cavity positioning device during deployment and withdrawal of the well cavity pump relative to vertical well bore 12 and cavity 20.

In operation, the cavity positioning device is deployed into vertical well bore 12 having the end and the counter balance portion positioned in a generally retracted condition, thereby disposing the end and the counter balance portion adjacent the well bore portion. As the well cavity pump travels downwardly within vertical well bore 12, a length of the cavity positioning device generally prevents rotational movement of the cavity positioning device relative to the well bore portion. For example, the mass of the counter balance portion may cause the counter balance portion and the end to be generally supported by contact with a vertical wall of vertical well bore 12 as the well cavity pump travels downwardly within vertical well bore 12.

As well cavity pump travels downwardly within vertical well bore 12, the counter balance portion causes rotational or pivotal movement of the cavity positioning device relative to the well bore portion as the cavity positioning device transitions from vertical well bore 12 to cavity 20. For example, as the cavity positioning device transitions from vertical well bore 12 to cavity 20, the counter balance portion and the end become generally unsupported by the vertical wall of vertical well bore 12. As the counter balance portion and the end become generally unsupported, the counter balance portion automatically causes rotational movement of the cavity positioning device relative to the well bore portion. For example, the counter balance portion generally causes the end to rotate or extend outwardly relative to vertical well bore 12. Additionally, the end of the cavity positioning device extends or rotates outwardly relative to vertical well bore 12.

The length of the cavity positioning device is configured such that the ends of the cavity positioning device become generally unsupported by vertical well bore 12 as the cavity positioning device transitions from vertical well bore 12 into cavity 20, thereby allowing the counter balance portion to cause rotational movement of the end outwardly relative to the well bore portion and beyond an annulus portion of sump 22. Thus, in operation, as the cavity positioning device transitions from vertical well bore 12 to cavity 20, the counter balance portion causes the end to rotate or extend outwardly such that continued downward travel of the well cavity pump results in contact of the end with a horizontal wall of cavity 20.

As downwardly travel of the well cavity pump continues, the contact of the end with the horizontal wall of cavity 20 causes further rotational movement of the cavity positioning device relative to the well bore portion. For example, contact between the end and the horizontal wall combined with downward travel of the well cavity pump causes the end to extend or rotate outwardly relative to vertical well bore 12 until the counter balance portion contacts a horizontal wall of cavity 20. Once the counter balance portion and the end of the cavity positioning device become generally supported by the horizontal walls of cavity 20, continued downward travel of the well cavity pump is substantially prevented, thereby positioning the inlet at a predefined location within cavity 20.

Thus, the inlet may be located at various positions along the well bore portion such that the inlet is disposed at the predefined location within cavity 20 as the cavity positioning device bottoms out within cavity 20. Therefore, the inlet may be accurately positioned within cavity 20 to substantially prevent drawing in debris or other material disposed within sump or rat hole 22 and to prevent gas interference caused by placement of the inlet 20 in the narrow well bore. Additionally, the inlet may be positioned within cavity 20 to maximize fluid withdrawal from cavity 20.

In reverse operation, upward travel of the well cavity pump generally results in releasing contact between the counter balance portion and the end with the horizontal walls, respectively. As the cavity positioning device becomes generally unsupported within cavity 20, the mass of the cavity positioning device disposed between the end and the axis generally causes the cavity positioning device to rotate. Additionally, the counter balance portion cooperates with the mass of the cavity positioning device disposed between the end and the axis to generally align the cavity positioning device with vertical well bore 12. Thus, the cavity positioning device automatically becomes aligned with vertical well bore 12 as the well cavity pump is withdrawn from cavity 20. Additional upward travel of the well cavity pump then may be used to remove the cavity positioning device from cavity 20 and vertical well bore 12.

Therefore, the present invention provides greater reliability than prior systems and methods by positively locating the inlet of the well cavity pump at a predefined location within cavity 20. Additionally, the well cavity pump may be efficiently removed from cavity 20 without requiring additional unlocking or alignment tools to facilitate the withdrawal of the well cavity pump from cavity 20 and vertical well bore 12.

Although the present invention has been described with several embodiments, various changes and modifications may be suggested to one skilled in the art. It is intended that the present invention encompass such changes and modifications as fail within the scope of the appended claims.

What is claimed is:

1. A system for surface production of gas from a coal seam, comprising:

a well bore;

a substantially horizontal well bore formed through the well bore, the substantially horizontal well bore in a coal seam and operable to conduct water and gas from the coal seam to a well bore junction;

the well bore junction proximate to the coal seam and horizontally offset from the well bore, the well bore junction operable to collect water from the substantially horizontal well bore for production to the surface; and a pump operable to pump water from the well bore junction to the surface.

2. The system of claim 1, wherein gas may be produced from the well bore junction to the surface.

3. The system of claim 1, the substantially horizontal well bore drilled through a well bore extending from the surface and including a radiused portion.

4. The system of claim 1, wherein the substantially horizontal well bore is drilled underbalanced.

5. The system of claim 1, wherein the substantially horizontal well bore is drilled underbalanced using foam.

6. The system of claim 1, wherein the substantially horizontal well bore is sloped.

7. The system of claim 1, further comprising at least one lateral well bore extending from the substantially horizontal well bore, the at least one lateral well bore drilled through a well bore extending to the surface and including a radiused portion.

8. The system of claim 1, further comprising a plurality of lateral well bores extending from the substantially horizontal well bore, the plurality of lateral well bores drilled through a well bore extending to the surface and including a radiused portion.

9. The system of claim 8, wherein the substantially horizontal well bore and the plurality of lateral well bores are drilled underbalanced.

10. The system of claim 8, wherein the substantially horizontal well bore and the plurality of lateral well bores are drilled underbalanced using foam.

11. A method for surface production of gas from a coal seam, comprising:

forming a well bore;

forming a substantially horizontal well bore through the well bore, the substantially horizontal well bore in a coal seam and operable to conduct water and gas from the coal seam to a well bore junction horizontally offset from the well bore;

conducting water and gas from a coal seam through the substantially horizontal well bore to the well bore junction, the well bore junction coupled to a portion of a well bore at least partially disposed below the substantially horizontal well bore;

collecting water from the substantially horizontal well bore in the fluid collection area for production to the surface;

pumping water from the well bore junction to the surface; and producing gas from the well bore junction to the surface.

12. The method of claim 11, further comprising drilling the substantially horizontal well bore through a well bore extending to the surface and including a radiused portion.

13. The method of claim 11, further comprising drilling the substantially horizontal well bore underbalanced.

14. The method of claim 11, further comprising drilling the substantially horizontal well bore underbalanced using foam.

15. The method of claim 11, further comprising drilling the substantially horizontal well bore at a slope in the coal seam.

16. The method of claim 11, further comprising:

conducting water and gas from a plurality of lateral well bores extending from the substantially horizontal well bore to the well bore junction; and collecting water from the substantially horizontal well bore and the plurality of lateral well bores at the well bore junction for production to the surface.

17. The method of claim 16, further comprising drilling the substantially horizontal well bore and the plurality of lateral well bores underbalanced.

18. The method of claim 16, further comprising drilling the substantially horizontal well bore and the plurality of lateral well bores underbalanced using foam.

* * * * *

UNITED STATES PATENT AND TRADEMARK OFFICE

CERTIFICATE OF CORRECTION

PATENT NO. : 8,297,350 B2
APPLICATION NO. : 11/982232
DATED : October 30, 2012
INVENTOR(S) : Joseph Alan Zupanick It is certified that error appears in the above-identified patent and that said Letters Patent is hereby corrected as shown below:

Column 1, line 32, delete "10/641,856," and insert -- 10/256,412, --.

Column 1, line 33, delete "6,976,533," and insert -- 6,679,322, --.

Signed and Sealed this
Twelfth Day of March, 2013

Teresa Stanek Rea
*Acting Director of the United States Patent and Trademark Office*